US005865669A

United States Patent [19]

Kiriyama et al.

[11] Patent Number: 5,865,669

[45] Date of Patent: Feb. 2, 1999

[54] ABRASIVE MACHINING APPARATUS EQUIPPED WITH A DEVICE FOR FACILITATING REPLACEMENT OF ABRASIVE TAPE

[75] Inventors: Kazuo Kiriyama, Nishikamo-gun; Hideyuki Tada, Toyota, both of Japan

[73] Assignee: Toyota Jidosha Kabushiki Kaisha, Toyota, Japan

[21] Appl. No.: 619,880

[22] Filed: Mar. 20, 1996

[30] Foreign Application Priority Data

Mar. 24, 1995 [JP] Japan ..... 7-066432

[51] Int. Cl.[6] ..... B24B 7/16

[52] U.S. Cl. ..... 451/168; 451/173; 451/49; 451/11; 451/302

[58] Field of Search ..... 451/168, 176, 451/302, 305, 306, 310, 355, 49, 303, 311, 173, 11

[56] References Cited

U.S. PATENT DOCUMENTS

| | | | |
|---|---|---|---|
| 4,993,191 | 2/1991 | Shimizu et al. . | |
| 4,999,953 | 3/1991 | Kinugawa et al. . | |
| 5,065,548 | 11/1991 | Shimizu et al. . | |
| 5,088,240 | 2/1992 | Ruble et al. | 451/63 |
| 5,437,125 | 8/1995 | Barton II | 451/49 |
| 5,536,201 | 7/1996 | Winkelmann . | |
| 5,651,719 | 7/1997 | Pineau . | |

FOREIGN PATENT DOCUMENTS

| | | |
|---|---|---|
| A-0 349 653 | 1/1990 | European Pat. Off. . |
| A- 0 366 506 | 5/1990 | European Pat. Off. . |
| A-0 434 533 | 6/1991 | European Pat. Off. . |
| 60-7952 | 1/1960 | Japan . |
| A-61-209457 | 9/1986 | Japan . |
| A-1-307920 | 12/1989 | Japan . |
| Y2-3-1168 | 1/1991 | Japan . |
| U-3-88657 | 9/1991 | Japan . |
| A-3-251358 | 11/1991 | Japan . |
| 5-169361 | 7/1993 | Japan . |
| A-5-169361 | 7/1993 | Japan . |
| 6-55430 | 3/1994 | Japan . |
| 7-75953 | 3/1996 | Japan . |

*Primary Examiner*—Robert A. Rose
*Assistant Examiner*—George Nguyen
*Attorney, Agent, or Firm*—Oliff & Berridge, PLC

[57] ABSTRACT

An apparatus for abrasive machining of a predetermined portion of a workpiece such that an abrasive tape and the workpiece are moved relative to each other while the tape is held in pressing contact with the predetermined portion of the workpiece, and such that the abrasive tape is fed in the longitudinal direction, the apparatus including a tape holding portion, and a tape cartridge removably held by the tape holding portion and carrying the abrasive tape, wherein the cartridge includes a housing, a tape supply portion disposed in the housing and accommodating an unused length of the tape such that a portion of the unused length is exposed outside the housing, a pressing member attached to the housing, for pressing the portion of the unused length outside the housing onto the predetermined portion of said workpiece, and a take-up portion disposed in the housing and accommodating a used length of the tape which has been used for abrasive machining of the predetermined portion of the workpiece in pressing contact therewith. The tape holding portion may include two or more tape holders each holding the tape cartridge.

25 Claims, 12 Drawing Sheets

ABRASIVE MACHINING APPARATUS EQUIPPED WITH A DEVICE FOR FACILITATING REPLACEMENT OF ABRASIVE TAPE

BACKGROUND OF THE INVENTION

1. Field of the Invention

The present invention relates to an apparatus or system adapted to perform an abrasive machining operation using an abrasive tape.

2. Discussion of the Related Art

There is known an abrasive machining apparatus of a type wherein an abrasive tape and a workpiece are moved relative to each other while the abrasive tape is forced onto a desired portion of the surface of the workpiece to be machined, and wherein the abrasive tape is fed in its longitudinal direction. The term "abrasive tape" is interpreted to mean a strip-like member which consists of a flat substrate made of a fabric, paper, synthetic resin or other suitable material, and an abrading material, usually in the form of abrasive particles bonded to the surface of the substrate. The abrasive tape is fed before, after or during an abrasive machining process. The abrasive machining processes include a grinding process and a lapping process, for example.

One form of the known abrasive machining apparatus of the type indicated above will be described by reference to FIG. 21. This prior art apparatus of FIG. 21 is not completely identical with but is similar to an abrasive machining apparatus disclosed in JP-U-60-7952 (laid-open publication in 1985 of Japanese Utility Model Application).

To begin with, the prior art abrasive machining apparatus will be briefly described. The apparatus is adapted to grind the outer circumferential surface of a cylindrical workpiece W, such that a grinding operation takes place at predetermined two positions of the outer circumference of the workpiece W which are opposed to each other in a diametric direction of the workpiece. The abrasive machining apparatus uses a single abrasive tape T, which is forced simultaneously onto the outer circumferential surface of the workpiece W at the above-indicated two diametrically opposite grinding positions. In operation of the apparatus, the workpiece W is rotated about its axis, relative to the abrasive tape T, to thereby grind the workpiece W. In this apparatus, the abrasive tape T is held stationary during each abrasive machining or grinding cycle on the workpiece W, and is fed by a predetermined distance in the longitudinal direction after each grinding cycle, that is, before the next cycle is initiated, so that unused portions of the abrasive tape T are forced onto the predetermined portions of the workpiece W in the next grinding cycle.

Described in detail, the abrasive machining apparatus includes a pair of shoes 400 which are disposed on the opposite sides of the workpiece W and are opposed to each other in a diametric direction of the workpiece W, as shown in FIG. 21. These shoes 400 are attached to end portions of respective clamp arms 402 which are pivotable about an axis of a shaft 401. The other end portions of the two clamp arms 402 are connected by an air cylinder 403, which permits the two opposed shoes 400 to be moved toward and away from each other and the workpiece W.

The predetermined two grinding positions of the workpiece W at which the grinding operation by the abrasive tape T takes place are the two diametrically opposite circumferential positions of the workpiece W at which the two shoes 400 are opposed to each other diametrically of the workpiece. The abrasive tape T is fed generally from right to left as seen in FIG. 21 wherein the right-hand side portion of the apparatus is a tape incoming side while the left-hand side portion is a tape outgoing side. The abrasive tape T is threaded through the apparatus, that is, between the shoes 400 and the outer circumferential surface of the workpiece W. Explained more particularly, a roll of an unused length of the abrasive tape T is carried by a supply reel 404 which is rotatably disposed on the body of the apparatus. The unused portion of the abrasive tape T supplied from the supply reel 404 is threaded via the shoes 400 while being guided by a suitable number of guide rolls 406 and the used portion of the tape T is directed up to the outgoing side of the apparatus and eventually ejected into a tape tray 408 provided there.

The path along which the abrasive tape T is threaded will be described in detail. The leading end portion of the abrasive tape T supplied from the supply reel 404 is first passed along the outer surface of the clamp arm 402 on the tape incoming side of the apparatus, while being guided by some of the guide rolls 406 The leading end portion of the tape T is then passed along the inner surface of the shoe 400 on the tape incoming side. The tape T is not turned through 180° around the workpiece W between the two shoes 400 but is turned around the guide roll 406 which is located between the workpiece W and the shaft 401 and between the two clamp arms 402 The tape T is then passed along the inner surface of the shoe 400 on the tape outgoing side of the apparatus, and along the outer surface of the clamp arm 402 on the tape outgoing side. The abrasive tape T thus threaded through the apparatus has respective portions which simultaneously contact the two diametrically opposite arcuate portions of the outer circumferential surface of the workpiece W. The tape has a non-contact portion between the two portions which contact the workpiece.

As described above, the abrasive tape T is threaded through the apparatus such that the tape T is not in contact with the two arcuate portions of the outer circumference of the workpiece W. This arrangement appears to be intended to permit easy and stable removal of the abrasive tape T away from the workpiece W upon installation and removal of the workpiece W on and from the abrasive machining apparatus, and to facilitate replacement of the tape T.

The present abrasive machining apparatus is adapted to feed the abrasive tape by a predetermined distance after termination of each grinding cycle, by rotating a pair of take-up rolls 410 which are geared with each other, so that a predetermined unused length of the tape T is supplied from the supply reel 404 toward the pair of shoes 400 and the corresponding used length of the tape T is ejected into the tape tray 408.

The prior art apparatus which has been described is of a workpiece rotation type adapted to perform a grinding operation by rotating the workpiece W relative to the abrasive tape T which is held stationary during the grinding operation. However, the relative movement of the workpiece W and the tape T may be effected by feeding the abrasive tape T continuously during the grinding operation while the workpiece W is held stationary.

The prior art abrasive machining apparatus has the following problems, irrespective of the type of relative movement between the workpiece and abrasive tape.

Generally, the abrasive tape used on the apparatus is replaced as needed by the operator of the apparatus. For instance, the replacement of the abrasive tape T is required when the machining surface of the tape T has become dull or "glazed", or when the tape is cut off for some reason or other during the operation of the apparatus.

In the known abrasive machining apparatus, however, the components such as the guide rolls and shoes associated with the replacement of the abrasive tape, that is, the components which define the path of the tape, are unremovably attached to the apparatus. Therefore, upon replacement of the used abrasive tape, the operator of the apparatus must remove the tape from the guide rolls, pass the new abrasive tape around the rolls, and make adjustments necessary to achieve correct threading of the new tape along the predetermined path through the apparatus. This operation is cumbersome and time-consuming, and makes it difficult to achieve abrasive machining operations with a sufficiently high efficiency. The apparatus suffers from this problem where the single abrasive tape is used for simultaneous grinding of two or more portions of the workpiece, as well as where the tape is used for grinding a single portion of the workpiece.

Thus, the known apparatus wherein the components defining the path of the abrasive tape are not removable suffers from low efficiency of replacement of the abrasive tape, irrespective of the type of relative movement between the abrasive tape and the workpiece, and irrespective of whether the abrasive tape is used to perform abrasive operation on one portion or a plurality of portions of the workpiece surface.

The abrasive machining apparatus shown in FIG. 21 uses one abrasive tape for performing simultaneous grinding operations at two grinding positions of the workpiece, as explained above. The abrasive tape is threaded in contact with one of the two diametrically opposite portions of the outer circumference of the workpiece while passing in one direction, and also in contact with the other circumferential portion of the workpiece while passing in the opposite direction. Thus, the threading path of the abrasive tape tends to be complicated, and increases the difficulty of replacement of the abrasive tape, leading to another problem, that is, an increased time required for replacing the abrasive tape.

The known apparatus of FIG. 21 has a further problem explained below.

The apparatus is of the workpiece rotation type adapted to perform abrasive machining operations by rotating the workpiece and to feed the abrasive tape by a predetermined distance after each machining cycle on the two portions of the workpiece. One of the two portions of the workpiece which is on the tape incoming side is necessarily contacted with an unused portion of the abrasive tape when the tape is fed. The other portion of the workpiece on the tape outgoing side must also be contacted with an unused portion of the tape. The portion of the tape used for the tape incoming side portion of the workpiece is fed between the two portions of the workpiece, as the non-contact portion indicated above. The used portion of the tape should not be used again for the tape outgoing side portion of the workpiece. Therefore, the tape should be fed by a distance corresponding to the length of the tape between the two portions of the workpiece, when the used portion of the tape has reached a point near the tape outgoing side of the workpiece. This feeding control of the tape is complicated, and a part of the tape cannot be used. If the tape is fed by a distance larger than the length of the tape between the two portions of the workpiece so that the tape outgoing side portion of the workpiece is necessarily contacted with the unused portion of the tape, a considerable part of the tape is wasted. Thus, the prior art apparatus suffers from wasting of the abrasive tape or requires a complicated control to feed the tape.

SUMMARY OF THE INVENTION

It is therefore a first object of the present invention to provide an abrasive machining apparatus which permits easy replacement of an abrasive tape.

It is a second object of the present invention to provide an abrasive machining apparatus which is adapted to perform an abrasive machining operation on the workpiece at a plurality of predetermined machining positions using respective abrasive tapes and which permits easy replacement of the abrasive tapes.

The first object indicated above may be achieved according to a first aspect of this invention, which provides an abrasive machining apparatus for performing an abrasive machining operation on a surface of a predetermined portion of a workpiece such that an abrasive tape and the workpiece are moved relative to each other while the abrasive tape is held in pressing contact with the surface of the predetermined portion of the workpiece, and such that the abrasive tape is fed in a longitudinal direction thereof, the apparatus comprising: a tape holding portion; and a tape cartridge removably held by the tape holding portion and carrying the abrasive tape, the tape cartridge including (a) a housing, (b) a tape supply portion disposed in the housing and accommodating an unused length of the abrasive tape such that a portion of the unused length is exposed outside the housing, (c) a pressing member attached to the housing, for pressing the portion of the unused length outside the housing onto the surface of the predetermined portion of the workpiece, and (d) a take-up portion disposed in the housing and accommodating a used length of the abrasive tape which has been used for abrasive machining of the surface of the predetermined portion of the workpiece in pressing contact therewith.

In the abrasive machining apparatus of the present invention constructed as described above, the abrasive tape is carried by the tape cartridge which is removably held by the tape holding portion of the apparatus. In this arrangement, the used abrasive tape can be easily replaced by simply removing the used abrasive tape together with the tape cartridge and attaching another tape cartridge carrying a new unused abrasive tape. This procedure for replacing the used abrasive tape does not require the operator or user of the apparatus to directly touch or manipulate the used and unused abrasive tapes. Thus, the replacement of the abrasive tape can be more easily achieved with higher efficiency than in the known apparatus which requires direct touching of the operator with the used and unused abrasive tapes.

An abrasive machining apparatus generally has a pressing member for pressing an abrasive tape onto the workpiece. Conventionally, this pressing member is provided on a portion of the apparatus other than the tape holding portion. In the present apparatus, on the other hand, the pressing member is provided on the tape cartridge. Generally, the pressing member partially defines a path of the abrasive tape. In the present apparatus, attachment of the tape cartridge to the tape holding portion automatically positions the pressing member so as to cooperate with the workpiece to define the path of the abrasive tape. Accordingly, the present arrangement eliminates the whole or a part of the tape path adjustment procedure.

The abrasive machining apparatus according to the first aspect of this invention described above may further comprise a controller for controlling a feeding of the abrasive tape. The controller may be adapted to feed the abrasive tape such that any length of the tape which has been used for abrasive machining of the workpiece is not used again. This type of tape cartridge is referred to as "one-time cartridge".

However, the abrasive tape may be repeatedly used for abrasive machining. That is, the abrasive tape which has been used may be used again. In this case, the tape supply portion and the take-up portion must be arranged such that the abrasive tape is circulated between the tape supply and take-up portions, and the controller is adapted to repeatedly use the abrasive tape. In this case, the tape cartridge is preferably provided with a dresser for dressing the abrasive tape, namely, to remove dull abrasive particles and also remove particles which have been transferred from the workpiece to the surface abrasive tape.

Where the tape cartridge is the one-time cartridge, that is, where the abrasive tape is used only once, the one-time tape cartridge may be adapted such that the tape supply portion includes a supply reel accommodating the unused length of the abrasive tape, and the take-up portion includes a take-up reel for winding the used length of the abrasive tape.

The abrasive machining apparatus may further comprise a tape feeding device including a drive source which is activated to feed the abrasive tape in the longitudinal direction by a predetermined distance before, during or after the abrasive machining operation.

In the above apparatus comprising the tape feeding device, the tape cartridge may be provided with the drive source for feeding the abrasive tape. Alternatively, the drive source may be provided on a member separate from the tape cartridge. In this latter case, the tape feeding device may include a support member which supports the drive source and which is separate from the tape cartridge, and a mechanism for selectively connecting and disconnecting the drive source to and from the tape cartridge such that the drive source is disconnected from the tape cartridge during the abrasive machining operation, and is connected to the tape cartridge before or after the abrasive machining operation to feed the abrasive tape by the predetermined distance. In this arrangement in which the drive source is not provided on the tape cartridge, the drive source is held stationary even when the abrasive machining operation requires a movement of the tape cartridge depending upon the portion of the workpiece to be machined. The present arrangement does not result in an increase of the inertia of the tape cartridge during the abrasive machining operation, permitting smooth movement of the tape cartridge. Further, the present arrangement eliminates means that would be otherwise required for preventing disconnection of electric wires connected to the drive source, and any other drawback which would occur due to movement of the drive source with the tape cartridge.

The abrasive machining apparatus may further comprise: a work holding device for holding the workpiece rotatably about an axis thereof; a work rotating device for rotating the workpiece about the axis during the abrasive machining operation while the workpiece is rotatably held by the work holding device; and a tape feeding device for feeding the abrasive tape in the longitudinal direction by a predetermined distance each time the abrasive machining operation is completed, so that a portion of the unused length of the abrasive tape is exposed outside the housing of the tape cartridge and brought into contact with the surface of the predetermined portion of the workpiece. In this instance, the work rotating device is operated to rotate the workpiece while the tape feeding device is held off to hold the abrasive tape stationary, whereby the abrasive tape and the workpiece are moved relative to each other to thereby perform the abrasive machining operation.

However, the abrasive machining operation may be effected by continuously feeding the abrasive tape in pressing contact with the predetermined portion of the workpiece while the workpiece is held stationary.

The tape holding portion may comprise two tape holders each of which removably holds the tape cartridge. IN this case, the two tape holders may be arranged so that unused portions of the abrasive tapes exposed outside the housings of the two tape cartridges are opposed to each other and positioned on opposite sides of the predetermined portion of the workpiece. This arrangement is preferable since a radial force which acts on the workpiece due to the abrasive machining by one of the two abrasive tapes is offset by a radial force which acts on the workpiece due to the abrasive machining by the other abrasive tape, because these two radial forces act in the opposite radial directions of the workpiece, that is, because the two abrasive tapes are forced against the workpiece at respective two diametrically opposite circumferential positions of the workpiece. Accordingly, the apparatus does not require any mechanism for preventing deflection or bending of the workpiece during the abrasive machining operation.

The tape holding portion may comprise three tape holders each of which removably holds the tape cartridge. In this case, the three tape holders may be arranged in a plane perpendicular to the axis of the workpiece such that the unused portions of the abrasive tapes exposed outside the housings of the three tape cartridges are equally spaced apart from each other around the circumference of the workpiece.

The tape holding portion comprises a plurality of tape holders each of which removably holds the tape cartridge and which are arranged in a plane perpendicular to an axis of the workpiece such that unused portions of the abrasive tapes exposed outside the housings of the plurality of tape cartridges are located in the plane and arranged about the axis of the workpiece.

Usually, the above-indicated plane is the vertical plane, which is generally perpendicular to the axis of the workpiece. However, the vertical plane on which the tape holders are arranged need not be perpendicular to the axis of the workpiece and may be inclined thereto.

Where the tape cartridge is the one-time cartridge having the supply reel and the take-up reel, the tape cartridge may comprise a mechanism for giving to the supply reel a resistance to rotation thereof when the unused length of the abrasive tape is pulled out of the supply reel by the take-up reel. This arrangement is effective to prevent loosening of the abrasive tape when the abrasive tape is fed from the supply reel by rotation of the take-up reel, or when the abrasive tape is pulled by rotation of the workpiece during the abrasive machining operation. The mechanism to give the rotation resistance to the supply reel may include an elastic member interposed between the housing of the tape cartridge and the supply reel. For example, the elastic member consists of an annular steel washer which is disposed coaxially with the supply reel and which is corrugated in a circumferential direction thereof so as to provide alternate raised and recessed portions extending in a radiation direction thereof.

Where the elastic member is interposed between the housing of the tape cartridge and the supply reel, the tape cartridge may further comprise a mechanism which is operated to change an amount of deformation of the elastic member for thereby adjusting the resistance to rotation of the supply reel.

The take-up reel may include a one-way clutch and is mounted on the housing of the tape cartridge such that the one-way clutch permits the take-up reel to rotate in a first direction for winding the used length of the abrasive tape and inhibits the take-up reel from rotating in a second direction opposite to the first direction. This arrangement is effective to prevent the abrasive tape from being pulled out of the take-up reel during the abrasive machining operation, thereby avoiding loosening of the abrasive tape between the take-up reel and the workpiece.

Where the tape cartridge includes the supply and take-up reels as described above, the apparatus may further comprise: a tape feeding device for feeding the abrasive tape in the longitudinal direction by a predetermined distance, the tape feeding device including a motor 126 for rotating the take-up reel; a feed length sensor provided on the tape holding portion, for detecting a length of the abrasive tape which has been fed by the tape feeding device; and a controller for controlling the motor of the tape feeding device, according to an output signal of the feed length sensor.

The abrasive machining apparatus wherein the tape cartridge includes the supply reel and the take-up reel may be adapted to further comprise: a used length sensor for detecting the used length of the abrasive tape which is currently wound on the take-up reel; an alarm indicator for informing an operator of the apparatus of a necessity of replacing the tape cartridge; and a controller for activating the alarm indicator according to an output signal of the used length sensor.

Alternatively, the abrasive machining apparatus may further comprise: an unused length sensor for detecting the unused length of the abrasive tape which is currently wound on the supply reel; an alarm indicator as described above; and a controller for activating the alarm indicator according to an output signal of the unused length sensor.

The pressing member attached to the housing of the tape cartridge may be formed to contact the workpiece at a single position, for example, along a single line, or over a single relatively wide area of the workpiece surface. In the latter case, the pressing member may have a part-circumferential contact surface following a part of the outer circumference of the workpiece at its predetermined portion to be machined. Alternatively, the pressing member may be formed to contact the workpiece at two or more positions, for instance, along two or more lines, or over two or more relatively wide areas of the workpiece surface. In the former case, the pressing member may have a V- or U-shaped contact surface which contacts the workpiece along two lines. In the latter case, the pressing member may have two or more part-circumferential contact surface portions arranged along a circle having the same diameter as the predetermined portion of the workpiece to be machined.

The second object indicated above may be achieved according to a second aspect of the present invention, which provides an abrasive machining apparatus for performing an abrasive machining operation on a surface of a predetermined portion of a workpiece such that a plurality of abrasive tapes and the workpiece are moved relative to each other while the abrasive tapes are held in pressing contact with the surface of the predetermined portion of the workpiece at a plurality of predetermined machining positions which are located in a plane intersecting an axis of the workpiece, and such that the abrasive tapes are fed in a longitudinal direction thereof, the apparatus comprising a plurality of tape holders for holding portions of the plurality of abrasive tapes at the predetermined machining positions, respectively, independently of each other.

In the abrasive machining apparatus constructed according to the second aspect of this invention as described above, the predetermined portion of the workpiece is machined at two or more predetermined machining positions by the respective abrasive tapes which are held by the respective tape holders independently of each other. In this arrangement, the path of each abrasive tape can be readily made simpler than in an arrangement in which a single abrasive tape is contacted with the workpiece at different positions of the workpiece. Accordingly, each abrasive tape can be more easily replaced with high efficiency. Further, the abrasive tapes can be effectively utilized with a minimum wasting thereof, where the abrasive machining operation is effected by rotating the workpiece while the abrasive tapes are held stationary, and the abrasive tapes are fed by a predetermined distance after each abrasive machining operation, for example.

Each of the tape holders may comprise a body portion, and a tape cartridge removably held by the tape holder and including (a) a housing, (b) a tape supply portion disposed in the housing and accommodating an unused length of the abrasive tape such that a portion of the unused length is exposed outside the housing, and (c) a take-up portion disposed in the housing and accommodating a used length of the abrasive tape which has been used for abrasive machining of the surface of the predetermined portion of the workpiece in pressing contact therewith.

In the above arrangement, the individual abrasive tapes are carried by the respective tape cartridges which can be removed from the body portions of the tape holders. Thus, the used abrasive tapes can be more easily replaced by simply removing the tape cartridges from the tape holders, and attaching the new tape cartridges on the tape holders, without operator's direct touching or manipulation of the used and new abrasive tapes.

The abrasive tapes may include two or more tapes having different widths. In other words, the tape holders include two or more holders capable of holding abrasive tapes having different widths. This arrangement permits abrasive machining of the workpiece in different conditions at the predetermined machining positions, with improved machining efficiency.

The abrasive machining apparatus according to the present second aspect of the invention may further comprise; a work holding device for holding the workpiece rotatably about an axis thereof; a work rotating device for rotating the workpiece about the axis during the abrasive machining operation while the workpiece is rotatably held by the work holding device; and a tape feeding device for feeding the plurality of abrasive tapes in the longitudinal direction by a predetermined distance each time the abrasive machining operation is completed, so that a portion of an unused length of each of the abrasive tapes is brought into contact with the surface of the predetermined portion of the workpiece. In this instance, the work rotating device is operated to rotate the workpiece while the tape feeding device is held off to hold the abrasive tapes stationary, whereby the abrasive tapes and the workpiece are moved relative to each other to thereby perform the abrasive machining operation.

In this second aspect of the invention, too, the tape holders may consist of two tape holders which are arranged so that unused portions of the abrasive tapes are opposed to each other and positioned on opposite sides of the predetermined portion of the workpiece. The tape holders may be arranged in a plane perpendicular to the axis of the workpiece and such that unused portions of the abrasive tapes are located in the plane perpendicular to the axis and arranged about the axis of the workpiece.

According to the present invention, there is also provided an abrasive machining apparatus for performing an abrasive machining operation on a surface of a predetermined portion of a workpiece such that the workpiece is rotated while two abrasive tapes are held stationary in pressing contact with the surface of the predetermined portion of the workpiece at different positions, and such that the abrasive tape is fed in a longitudinal direction thereof, the apparatus comprising: a frame having a downward extension; a clamp unit connected to the downward extension and including a pair of clamp arms which are movable toward and away from each other; a pair of tape holders supported by the pair of clamp arms, respectively, the pair of tape holders holding the two abrasive tapes, respectively, independently of each other; a tape feeding device for feeding the two abrasive tapes in the longitudinal direction while the two abrasive tapes are held by the tape holders; and a work holding device for holding the workpiece rotatably about an axis thereof; and a work rotating device for rotating the workpiece about the axis during the abrasive machining operation while the workpiece is rotatably held by the work holding device.

The above apparatus is preferably adapted such that the clamp unit is connected to the downward extension of the frame such that the clamp unit is movable relative to the frame in a plane intersecting the axis of the workpiece rotatably held by the work holding device. This arrangement is particularly desirable where the predetermined portion of the workpiece is radially offset from the axis and rotates about the axis when the workpiece is rotated by the workpiece rotating device. In this case, the clamp unit is moved relative to the frame in the plane so that the pair of tape holders supported by the pair of clamp arms of the clamp unit follow the rotation of the predetermined portion of the workpiece about the axis of the workpiece.

BRIEF DESCRIPTION OF THE DRAWINGS

The above and optional objects, features, advantages and technical and industrial significance will be better understood by reading the following detailed description of presently preferred embodiments of the invention, when considered in connection with the accompanying drawings, in which.

DETAILED DESCRIPTION OF THE PREFERRED EMBODIMENTS

Figure 1:
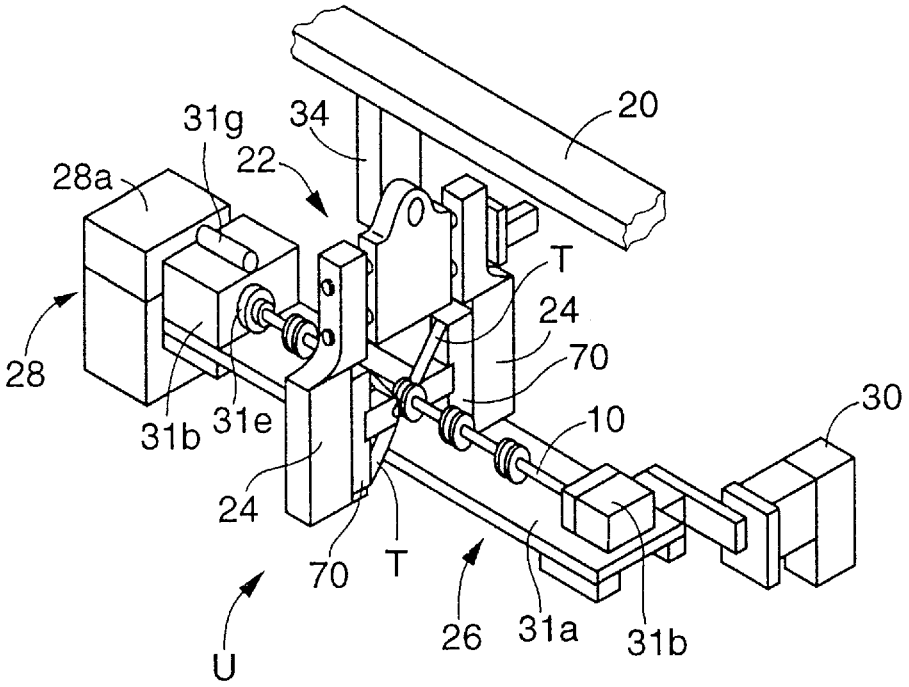
FIG. 1 is a perspective view showing an abrasive machining system including an abrasive machining apparatus constructed according to one embodiment of this invention.

Referring first to the perspective view of FIG. 1, there is shown an abrasive machining system including an abrasive machining apparatus constructed according to one embodiment of this invention. The abrasive machining system is adapted to perform an abrasive machining operation on a workpiece W such that the workpiece W is rotated about its axis while an abrasive tape T is held stationary in pressing contact with a desired portion of the workpiece. The abrasive tape T is fed by a predetermined distance upon completion of each abrasive machining operation on the workpiece, so that an unused portion of the abrasive tape T is used for the next abrasive machining operation. The abrasive machining system uses two abrasive tapes for abrasive machining operations on the workpiece at two diametrically opposite circumferential positions of the workpiece. The two abrasive tapes T are forced onto the corresponding two diametrically opposite portions of the outer circumferential surface of the workpiece, independently of each other, for effecting abrasive machining operations at the predetermined two grinding positions independently of each other.

The workpiece to be subjected to the abrasive machining by the present abrasive machining system is a crankshaft which has a plurality of outer circumferential surfaces that are spaced from each other in the axial direction.

Figure 2:
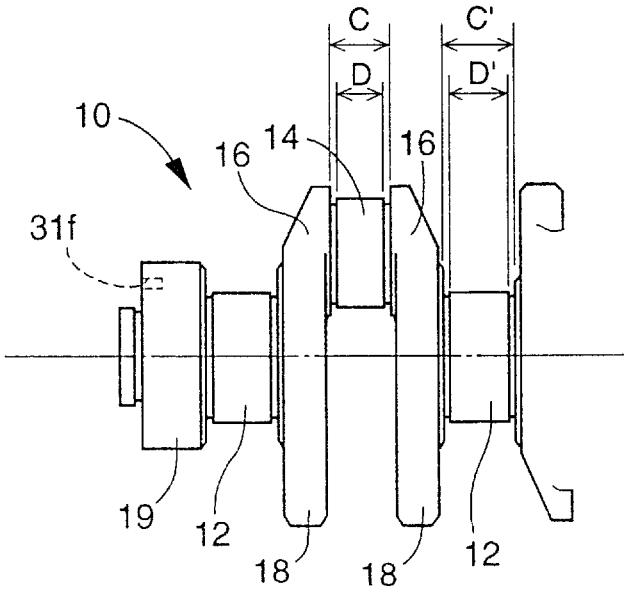
FIG. 2 is a fragmentary plan view of an example of a workpiece in the form of a crankshaft to be ground by the abrasive machining system of FIG. 1.

The crankshaft as the workpiece, indicated at 10 in FIGS. 1 and 2, is a component of an engine of a motor vehicle, which has a plurality of journal portions 12 to be supported by cylinder blocks, and a plurality of pin portions 14 to be connected to pistons through connecting rods. The journal portions 12 and the pin portions 14 are alternately arranged in the axial direction of the crankshaft 10. The journal portions 12 are coaxial with the axis of rotation of the crankshaft 10, while the pin portions 14 are offset from the axis of the crankshaft 10. In operation of the engine, reciprocating motions of the pistons are converted into a rotating motion of the crankshaft 10. The adjacent journal and pin portions 12, 14 are connected to each other by an arm 16 which extends in the radial direction of the crankshaft 10. The arm 16 has a balance weight 18 at a position thereof most remote from the pin portion 14. The crankshaft 10 has an output flange 19 formed at one of its opposite axial ends.

The present abrasive machining system is designed to effect abrasive machining of the outer circumferential surface of each journal portion 12 and the outer circumferential surface of each pin portion 14. Described in detail, the system is adapted to perform two abrasive machining processes. In the first machining, all of the journal portions 12 of the crankshaft 10 are lapped simultaneously. In the second machining process, all of the pin portions 14 are lapped simultaneously. In the present example, the abrasive machining is a lapping process to achieve ultra-fine surface finish of the outer circumferential surfaces of the journal and pin portions 12, 14 by using the abrasive tapes T made of paper tapes charged or impregnated with suitable abrasive particles. The lapping operation is performed in the presence of a suitable machining liquid.

As shown in FIG. 1, the abrasive machining system includes a frame 20, a clamping unit 22, a pair of tape holders 24, a work holding device 26, a work rotating device 28 and an oscillating device 30. The clamping unit 22 and the pair of tape holders 24 constitute an abrasive machining unit U. Although FIG. 1 shows only one abrasive machining unit U, by way of example, the abrasive machining system uses a plurality of abrasive machining units U corresponding to the respective journal or pin portions 12, 14, so that the journal or pin portions 12, 14 may be lapped at one time as indicated above.

Figure 3:
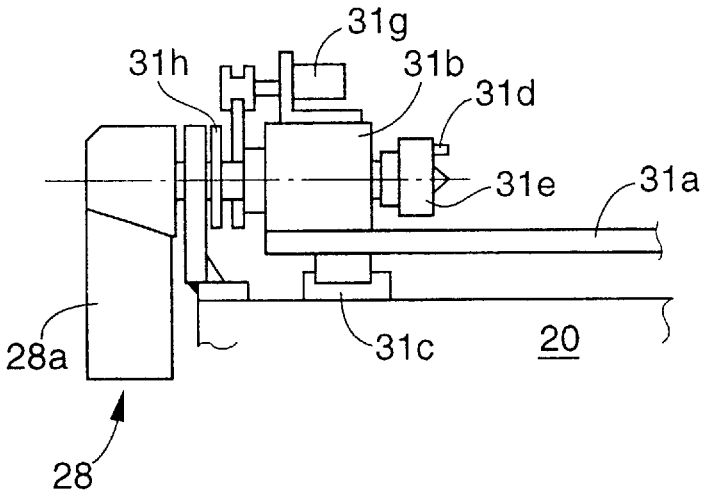
FIG. 3 is a side elevational view showing in enlargement a workpiece rotating device and the associated components of the system of FIG. 1.

The work holding device 26 includes a table 31*a* having a flat top surface, and two work support portions 31*b* mounted on the table 31*a*. These work support portions 31*b* are headstock and tailstock having respective centers for engagement with the opposite end faces of the crankshaft 10, to thereby hold the crankshaft 10 rotatably about its axis. As shown in the side elevational view of FIG. 3, the table 31*a* is mounted on the stationary frame 20 through rails 31*c*, such that the table 31*a* is movable in the axial direction of the crankshaft 10.

The headstock 31*b* of the work holding device 26 is provided with a drive shaft 31*e* which has the center and a drive pin 31*d*. The center is aligned with the axis of the drive shaft 31*e*, while the drive pin 31*d* is radially offset from the axis of the drive shaft 31*e*. As shown in FIG. 2, a hole 31*f* is formed in the flange portion 19 of the crankshaft 10, such that the hole 31*f* is offset from the axis of the crankshaft 10. When the crankshaft 10 is rotatably supported by and between the two work support portions 31*b* in the form of the headstock and tailstock, the drive pin 31*d* is inserted into the hole 31*f*, so that the crankshaft 10 is rotated by the drive shaft 31*e*. The headstock 31*b* of the work holding device 26 supports the drive shaft 31*e* such that the drive shaft 31*e* is axially movable toward and away from the tailstock 31*b* by activation of an air cylinder 31*g* as a drive source.

The work holding device 26 incorporates a positioning mechanism for positioning the crankshaft 10 in the direction of rotation about its axis. As shown in the front elevational view of FIG. 4, this positioning mechanism includes (a) a rotary member 31*h* (also shown in FIG. 3) which is rotated with the drive shaft 31*e* and which has a cutout 31*i* at a predetermined circumferential position, (b) an air cylinder 31*j* as a drive source, and (c) an engaging portion 31k which is moved by the air cylinder 31*j* toward and away from the rotary member 31*h*.

Figure 4:
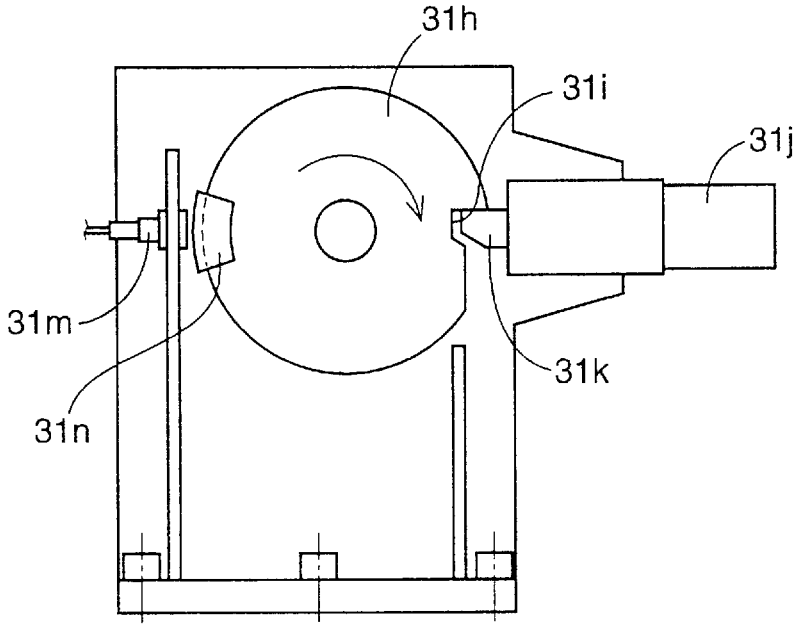
FIG. 4 is a front elevational view showing in enlargement a rotary member and the associated components of the workpiece rotating device of FIG. 3.

The engaging portion 31*k* driven by the air cylinder 31*j* is normally placed at a retracted position away from the rotary member 31*h*. To position the crankshaft 10 in the rotating direction, the air cylinder 31*j* is activated to bring the engaging portion 31*k* into contact with the outer circumferential surface of the rotary member 31*h* while the rotary member 31*h* is rotated with the drive shaft 31*e* and crankshaft 10. The engaging portion 31*k* in sliding contact with the rotary member 31*h* is brought into engagement with the cutout 31*i* at the predetermined position of the crankshaft 10 in its rotating direction. That is, the crankshaft 10 is locked at the predetermined position corresponding to the circumferential position of the cutout 31*i*. The rotary member 31*h* is rotated by a motor which will be described, and is provided with a dog 31*n* which is detected by a proximity switch 31*m*, as indicated in FIG. 4. When the dog 31*n* is detected by the proximity switch 31*m* for the first time after the abrasive machining or lapping of the crankshaft 10 is terminated, the motor for rotating the rotary member 31*h* is decelerated or slowed down, and then the air cylinder 31*j* is activated to advance the engaging portion 31*k* into sliding contact with the outer circumferential surface of the rotary member 31*h*. This arrangement is effective to avoid a failure of the engaging portion 31*k* to engage the cutout 31*i* due to an excessive high rotating speed of the rotary member 31*h*, and prevent mechanical damage of the engaging portion 31*k* and/or rotary member 31*h* due to a large force of abutting contact of the engaging portion 31*k* with a surface of the cutout 31*i*.

The work rotating device 28 includes an electric motor 28*c* as a drive source for rotating the drive shaft 31*e* about its axis and consequently the crankshaft 10. The work rotating device 28 is mounted on the frame 20 such that an output shaft of the motor 28*a* is splined to the drive shaft 31*e*, so as to permit relative axial movements of the drive shaft 31*e* and the output shaft of the motor 28*a*, whereby the is table 31*a* is movable with the drive shaft 31*e* (headstcok 31*b*) in the axial direction of the drive shaft 31*e*.

The oscillating device 30 shown in FIG. 1 is provided to oscillate the table 31*a* of the work holding device 26 in its longitudinal direction, more precisely, to oscillate the crankshaft 10 in the axial direction during an abrasive machining operation on the crankshaft 10. As shown in FIG. 2, each pin portion 14 has an axial length C, and each journal portion 12 has an axial length C'. Further, each pin portion 14 has an axially central cylindrical surface for engagement with the connecting rod of the engine, and two grooves or rounds on the opposite sides of the cylindrical surface. The cylindrical surface of the pin portion 14 has an axial length D which is shorter than the axial length C. Similarly, each journal portion 12 has an axially central cylindrical surface for engagement with the cylinder block of the engine. The cylindrical surface of the journal portion 12 has an axial length D' which is shorter than the axial length C'. In the present embodiment, the width of each abrasive tape T is substantially equal to the axial length D of each pin portion 14, so that the journal and pin portions 12, 14 can be reciprocated in the axial direction while the tapes T are held in contact with the central cylindrical surfaces of the journal and pin portions 12, 14. In operation of the abrasive machining system, the crankshaft 10 is oscillated in the axial direction by the oscillating device 30, during rotation of the crankshaft 10. The rotating and axial motions of the crankshaft 10 relative to the abrasive tapes T cause the cylindrical surfaces of the journal and pin portions 12, 14 to be subjected to abrasive machining in a cross hatching pattern, whereby the machined surfaces are given intended surface roughness and a property to retain a lubricant.

As shown in FIG. 1, the frame 20 has a downward extension 34 extending vertically from a portion thereof located above the work holding device 26. To this downward extension 34, there is attached the above-indicated clamp unit 22, which is operated selectively in one of opposite directions for moving the pair of tape holders 24 toward and away from each other. The clamp unit 22 is provided with a body portion 36 and a pair of clamp arms 38, as shown in the front elevational view of FIG. 5.

If each abrasive machining unit U was used for lapping only the corresponding journal portion 12 coaxial with the axis of the crankshaft 10, the unit U would not be required to be movable in the vertical plane. However, the abrasive machining unit U is actually used for lapping the pin portion 14 as well as the journal portion 12. Since the rotation of the crankshaft during lapping thereof causes rotation of the pin portion 14 about the axis of rotation of the crankshaft 10, the abrasive machining unit U is required to be moved in the vertical plane, following the rotation of the pin portion 14 about the axis of the crankshaft 10. To this end, the clamp unit 22 is connected to the frame 20 in the following manner.

The body portion 36 of the clamp unit 22 has a pin hole 40 formed at an upper end part thereof, while the downward extension 34 of the frame 20 has an elongate hole 42 extending in the vertical direction. The body portion 36 is connected to the downward extension 34 by a pin 44 which is inserted in the pin hole 40 and the elongate hole 42. In this arrangement, the body portion 36 is freely pivotable about the axis of the pin 44, and the pin 44 is movable within the elongate hole 42 in the vertical direction. Thus, the clamp unit U is pivotable in the vertical plane (in the plane of FIG. 5), about the center of the pin hole 40 which is vertically movable.

The body portion 36 has another pin hole 48 formed at a lower end part thereof. This pin hole 48 is provided for inhibiting a movement of the body portion 36, that is, for holding the body portion 36 at a predetermined position. Described more specifically, the pin hole 48 is engageable with a pin 50, which is provided on the downward extension 34 as a positioning member. This pin 50 is operated by an air cylinder 49 incorporated in the downward extension 34. During an abrasive machining operation of the present system, the pin 50 is placed at a retracted position away from the pin hole 48, to thereby permit a movement of the body portion 36. When the workpiece W is positioned relative to the pair of tape holders 24, for example, the air cylinder 49 is actuated to move the pin 50 into the pin hole 48 to thereby lock the body portion 36 at the predetermined position. This locking of the body portion 36 by engagement of the pin 50 with the pin hole 48 is effected after the crankshaft 10 is positioned at the predetermined position in its rotating direction by the positioning mechanism of the work holding device 26 including the air cylinder 31*j*.

Figure 5:
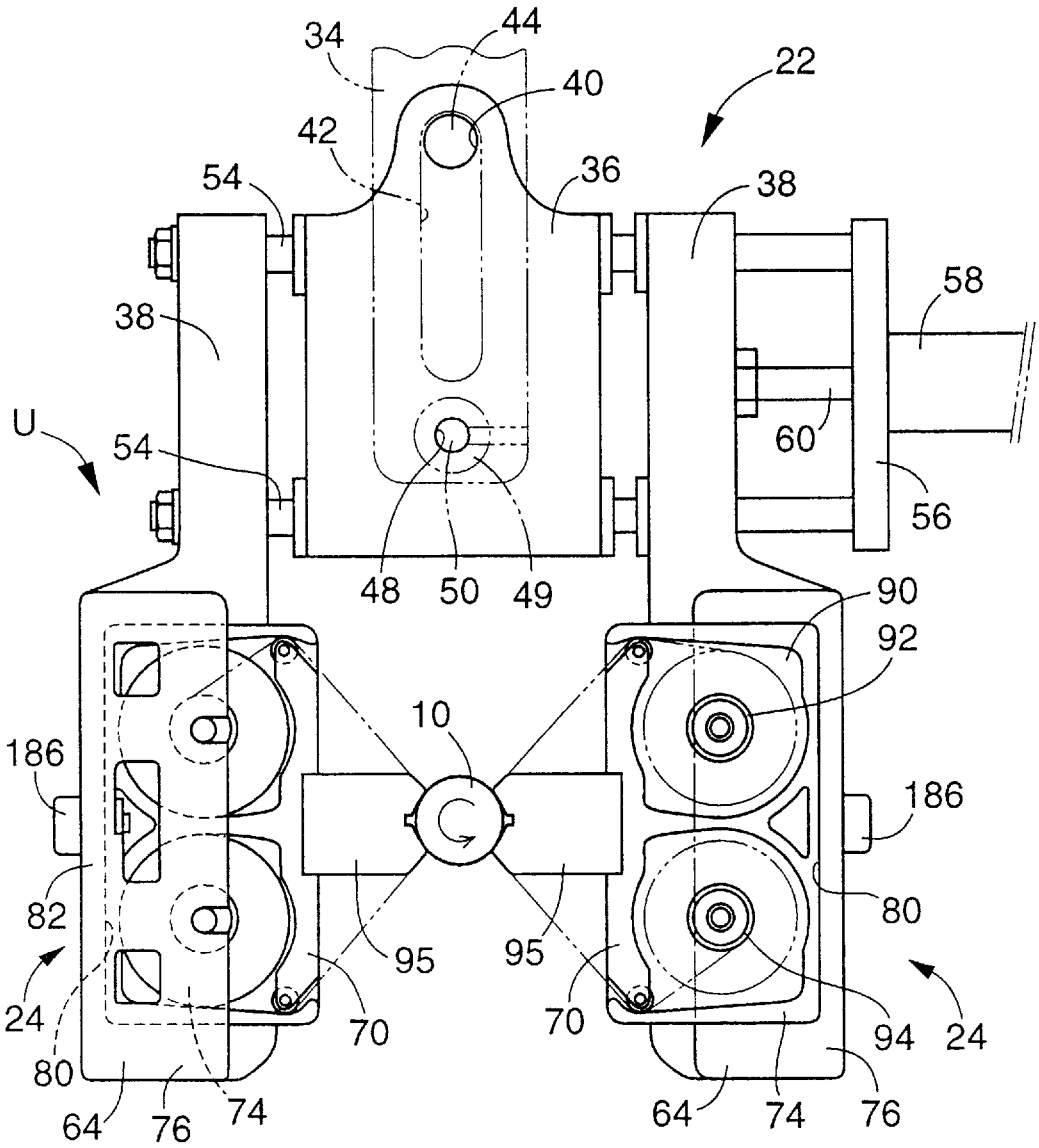
FIG. 5 is a front elevational view showing in enlargement an abrasive machining unit U provided in the system of FIG. 1.

A pair of parallel support shafts 54 extend through the body portion 36 of the clamp unit 22 such that the body portion 36 is slidable relative to the support shafts 54. These two support shafts 54 are spaced apart from each other in the vertical direction and are exposed outside the body portion 36 at their opposite end portions. The two clamp arms 38 are carried at the exposed end portions of the support shafts 54. That is, the left clamp arm 38 as seen in FIG. 5 is fixed at its proximal end portion to the left end portions of the support shafts 54, while the right clamp arm 38 is supported at its proximal end portion by the right end portions of the support shafts 54 such that the right clamp arm 38 is movable slidably on the support shafts 54 in the axial direction of the support shafts 54. To the extreme right ends of the support shafts 54, there is secured a housing 56 of a clamp cylinder 58. A piston rod 60 extends from the clamp cylinder 58, and is connected to the right clamp arm 38, at its end remote from the clamp cylinder 58. In the present embodiment, the clamp cylinder 58 is hydraulically operated.

In the clamp unit 22 constructed as described above, an operation of the clamp cylinder 58 to move the piston rod 60 to its retracted position will cause the two clamp arms 38 to be moved away from each other, while an operation of the clamp cylinder 58 to move the piston rod 60 to its advanced position will cause the two clamp arms 38 to be moved toward each other.

There will next be described the pair of tape holders 24, 24 of each abrasive machining unit U whose clamp unit 22 has been described in detail. Since the two tape holders 24 are identical in construction with each other, only one of the tape holders 24 will be described.

As shown in FIG. 5, the tape holder 24 consists of a body portion 64 formed as a free end portion of the corresponding clamp arm 38, and a tape cartridge 70. The body portion 64 has a cartridge accommodating space 74, and the tape cartridge 70 is removably accommodated in the space 74.

Figure 11:
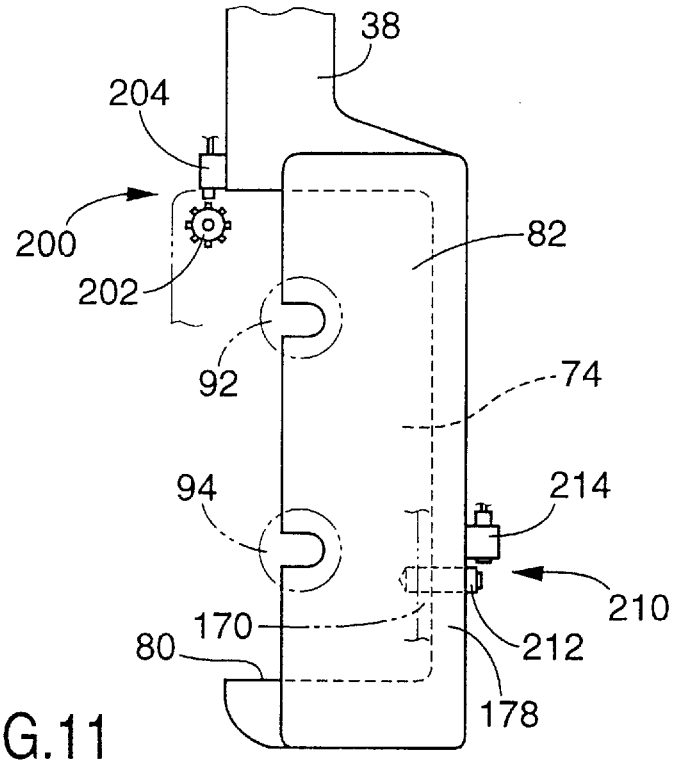
FIG. 11 is a front elevational view showing a used length sensor and an unused length sensor which are provided on each clamp arm shown in FIG. 5.

Described more specifically, the free end portion of the clamp arm 38 has a cutout 80 formed therethrough as also shown in FIG. 11, such that the openings of the cutouts 80 of the two clamp arms 38 face each other, as indicated in FIG. 5. The free end portion of the clamp arm 38 has a closure member in the form of a pair of plate members 82 attached to its opposite surfaces. The plate members 82 extend parallel to each other in the vertical direction (parallel to the plane of FIG. 5), so as to close the cutout 80 for thereby defining the cartridge accommodating space 74 in each tape holder 24. The cartridge accommodating spaces 74 of the two tape holders 24 extend in the vertical direction, and are formed such that the bottom surfaces of the two spaces 74 face each other. As shown in FIG. 5, the plate members 82 have a plurality of windows which permit the user to inspect the condition of the tape cartridge 70 accommodated in the space 74. It is noted that FIG. 5 shows the left-hand side tape holder 24 after the plate members 82 are attached to the clamp member 38, and the right-hand side tape holder 24 before the plate members 82 are attached to the clamp member 38.

Figure 6:
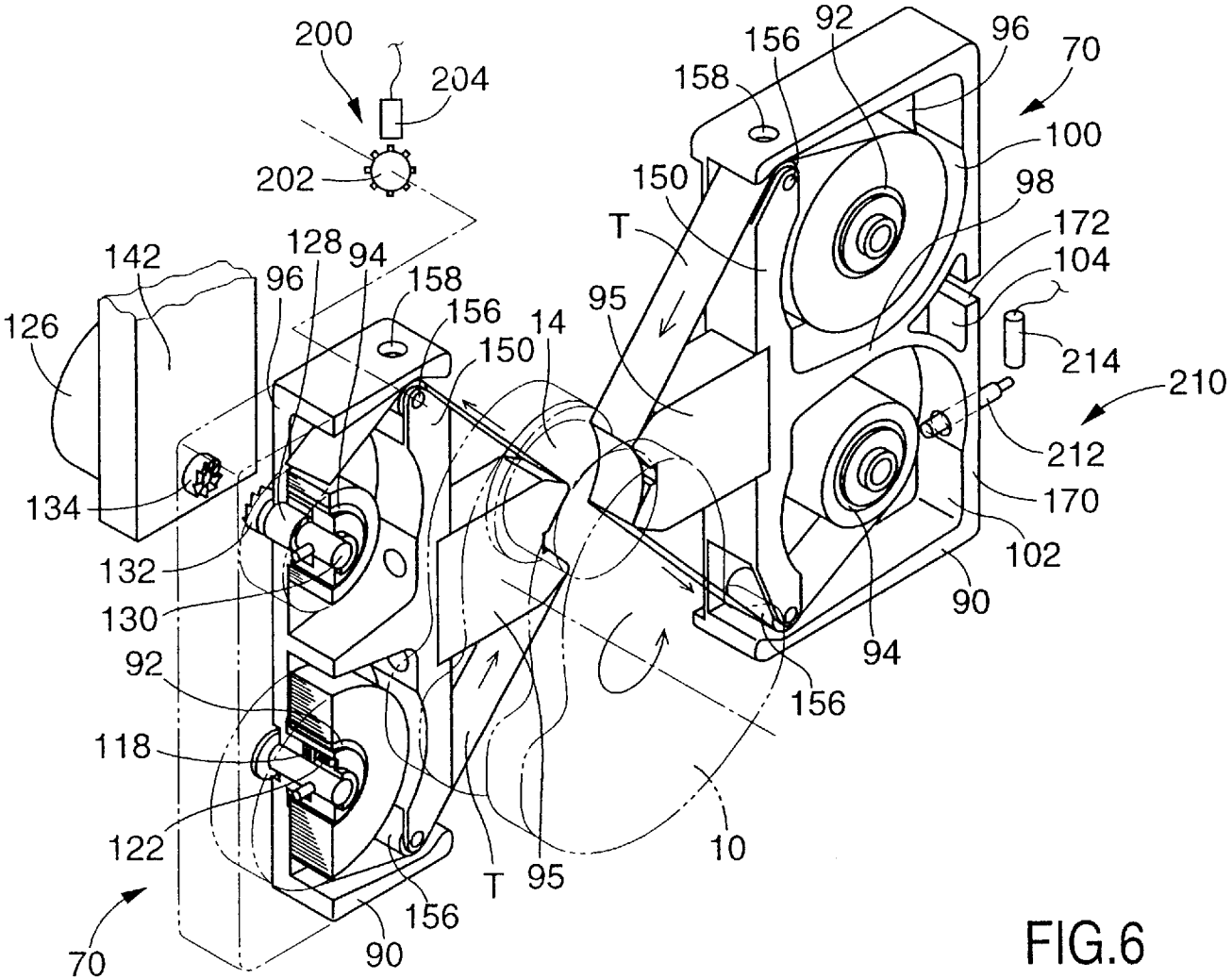
FIG. 6 is a perspective view showing in enlargement a pair of tape cartridges.

As most clearly shown in the perspective view of FIG. 6, the tape cartridge 70 accommodates and holds a pair of reels such that the reels lie in the same plane. The abrasive tape T is wound on these two reels. Described in detail, the tape cartridge 70 includes a housing 90, a supply reel 92 and a take-up reel 94 that are accommodated in and supported by the housing 90, and a pressing member in the form of a shoe 95 attached to the housing 90. In FIG. 6, the supply and take-up reels 92, 94 in the left-hand side tape cartridge 70 are shown in cross section taken in a plane which includes the axes of rotation of those reels.

The housing 90 has a rectangular box structure, having four walls defining a rectangular frame, and one bottom wall which is parallel to the plane of rotation of the reels 92, 94 and which closes the rectangular frame at one open end thereof. Thus, the cartridge 70 has an opening at one side of the rectangular box structure, which side is opposite to the above-indicated bottom wall. When the cartridge 70 is accommodated in the cartridge accommodating space 74 of the tape holder 24, the opening of the cartridge 70 is closed by one of the two plate members 82, as shown in FIG. 5 (left-hand side tape holder 24). This tape cartridge 70 has a reduced thickness in the absence of a wall opposite to the bottom wall, and an accordingly reduced weight. In the present embodiment, the housing 90 is made of aluminum, contributing to reduction in the weight of the tape cartridge 70.

Figure 18:
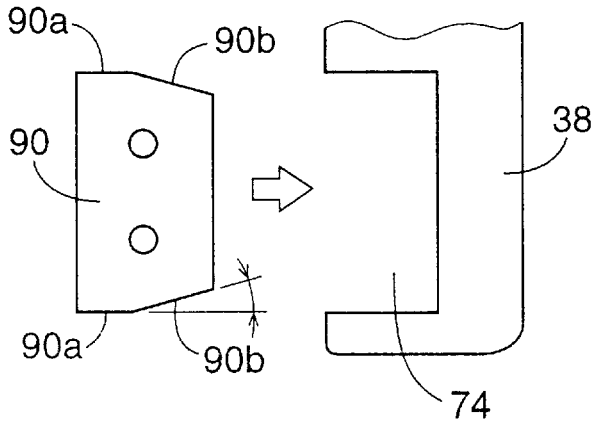
FIG. 18 is a front view for explaining a manner in which the tape cartridge is attached to the clamp arm.

As shown in FIG. 18, each of the opposite upper and lower walls of the rectangular frame of the housing 90 has a parallel outer surface 90a and an inclined outer surface 90*b* which is inclined with respect to the parallel outer surface 90*a*. The parallel outer surfaces 90*a* of the upper and lower walls are parallel to each other, extending in the horizontal direction when the cartridge 70 is accommodated in the cartridge accommodating space 74. The inclined outer surfaces 90*b* are formed such that the distance between the inclined outer surfaces 90*b* decreases in a direction away from the parallel surfaces 90*a*. Thus, the housing 90 has two chamfered corners for facilitating the insertion of the cartridge 70 into the space 74 of the tape holder 24. Further, the parallel outer surfaces 90*a* function to position the cartridge 70 in place in the space 74, without a rattling movement in the vertical direction.

Referring back to FIG. 6, the above-indicated bottom wall of the housing 90 is indicated at 96. On the inner surface of the bottom wall 96, there is formed a partition wall 98 so as to extend toward the opening of the housing 90. The partition wall 98 is located intermediate between the upper and lower walls of the housing 90, and is bifurcated, so as to divide the space in the housing 90 into three sections, namely, a supply reel chamber 100, a take-up reel chamber 102, and a lock chamber 104. The supply reel 92 is accommodated in the supply reel chamber 100, while the take-up reel 94 is accommodated in the take-up reel chamber 102.

There will be described a mechanism for rotating the supply and take-up reels 92, 94 in the tape cartridge 70.

Figure 7:
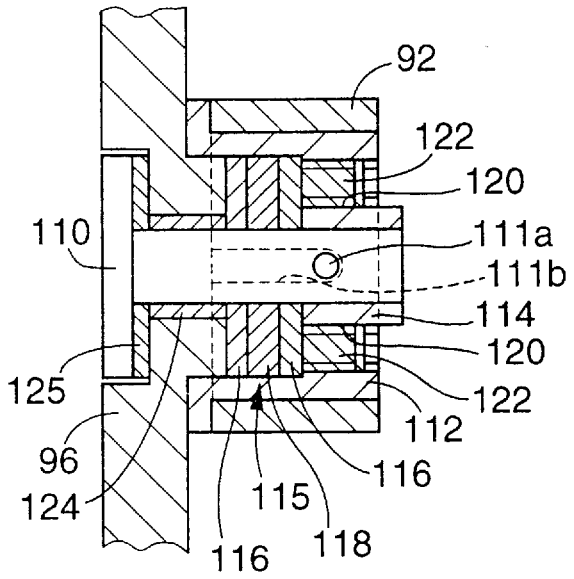
FIG. 7 is an elevational view in cross section of a mechanism for rotatably supporting a tape supply reel of the tape cartridge of FIG. 6.

As shown in the cross sectional view of FIG. 7, the supply reel 92 is supported by a flanged rotary shaft 110 which is rotatably supported by the bottom wall 96 of the housing 90. The supply reel 92 is mounted on the rotary shaft 110 such that the supply reel 92 is axially slidably movable on the rotary shaft 110 and is rotated with the rotary shaft 110. In the present embodiment, means for preventing relative rotation of the supply reel 92 and the rotary shaft 110 includes a pin 111*a* inserted through the rotary shaft 110 in a diametric direction of the rotary shaft 110, and a groove 111*b* formed in the inner circumferential surface of the supply reel 92 in the axial direction of the reel 92. The supply reel 92 is mounted on the rotary shaft 110, with the pin 111*a* being held in sliding engagement with the axial groove 111*b*.

The supply reel 92 must be provided with a mechanism for providing a resistance to rotation thereof in order to prevent the abrasive tape T from getting slack when the tape T is supplied from the supply reel 92 due to rotation of the take-up reel 94. This mechanism will be described.

The supply reel 92 is supported by the rotary shaft 110 via a rotary member 112 in the form of a sleeve, such that the rotary member 112 is rotated with the supply reel 92. The rotary member 112 has a bottom wall 114 which cooperates with the bottom wall 96 of the housing 90 to define an annular space 115 therebetween. In the annular space 115, there are disposed a pair of spacers 116, and an elastic member in the form of a corrugated washer 118 which is a substantially annular steel washer that is corrugated in its circumferential direction so as to provide alternate raised and recessed portions extending in the radial direction. The rotary shaft 110 is inserted through two spacers 116 and the corrugated washer 118, and the washer 118 is sandwiched by and between the two spacers 116.

In the above arrangement, the bottom wall 114 of the rotary member 112 engages the bottom wall 96 via the pair of spacers 116 and the corrugated washer 118, whereby there arises a friction force between the rotary member 112 and the bottom wall 96 when the rotary member 112 is rotated. Accordingly, the supply reel 92 is given a resistance to rotation during rotation thereof by the take-up reel 94 through the abrasive tape T, so that the abrasive tape T is prevented from being loosened. It will be understood that the corrugated washer 118 constitutes a major portion of means for giving a resistance to rotation of the supply reel 92.

The rotary member 112 has a plurality of tapped holes 120 formed therethrough in a direction parallel to the axis of the rotary shaft 110. Adjusting screws 122 are threaded in the respective tapped holes 120, such that the adjusting screws 122 are held at their ends in engagement with one of the spacers 116. As the adjusting screws 122 are tightened, the distance between the adjusting screws 122 and the bottom wall 96 is reduced, and the thickness of the corrugated washer 118 is accordingly reduced. Thus, the adjusting screws 122 can be used to adjust the elastic force produced by the corrugated washer 118 in the direction perpendicular to its plane, and thereby adjust the fiction force to be produced between the rotary member 112 and the bottom wall 96, for adjusting the rotation resistance of the supply reel 92. It will be understood that the adjusting screws 122 constitute a major portion of means for adjusting the rotation resistance of the supply reel 92.

In FIG. 7, reference numeral 124 denotes a sleeve, and reference numeral 125 denotes a washer. The sleeve 124 is provided to minimize the wear of the bottom wall 96 by the rotary shaft 110, and the washer 125 is provided so that the friction force between the flange portion of the rotary shaft 110 and the bottom wall 96 is smaller than the friction force produced in the presence of the corrugated washer 118.

On the other hand, the take-up reel 94 must be prevented from rotating in a direction opposite to its normal rotating direction to take-up the abrasive tape T, in order to prevent the tape T from being loosened during an abrasive machining operation on the crankshaft 10. As described below in detail, the take-up reel 94 is connected to a motor 126 and given a torque to wind the abrasive tape T when the tape T is fed. During the abrasive machining operation, the motor 126 is disconnected from the take-up reel 94, as indicated in FIG. 6, and the crankshaft 10 is rotated in a direction that tends to cause a friction force to be generated between the crankshaft 10 and the tape T, which friction force acts to pull the tape T in the direction from the take-up reel 94 toward the supply reel 92, that is, in the direction opposite to the normal rotating direction of the take-up reel 94. Therefore, the take-up reel 94 must be provided with a mechanism for preventing its reverse rotation during operation of the abrasive machining system.

The mechanism for preventing the reverse rotation of the take-up reel 94 includes a one-way clutch 128 through which a rotary shaft 130 is rotatably supported by the bottom wall 96 of the housing 90, as shown at left in FIG. 6. The take-up reel 94 is mounted on the rotary shaft 130 such that the take-up reel 94 is axially slidably movable on the rotary shaft 130 and is rotated with the rotary shaft 130. The one-way clutch 128 permits the rotary shaft 130 to rotate in only one of the opposite directions, namely, in the direction that causes the take-up reel 94 to take-up the abrasive tape T, and inhibits the rotary shaft 130 in the other direction that causes the abrasive tape T to be unwound from the take-up reel 94. In the present embodiment, therefore, the abrasive tape T is inhibited by the one-way clutch 128 from being unwound from the take-up reel 94 due to the friction force between the crankshaft 10 and the tape T, and the tape T is therefore prevented from getting slack or loose during the abrasive machining operation on the crankshaft 10.

The motor 126 is connectable to the rotary shaft 130 through a clutch mechanism in the form of a pair of clutches 132, 134. The clutch 132 which is a driven member of the clutch mechanism is connected to the rotary shaft 130 for rotation therewith, while the clutch 134 which is a driving member of the clutch mechanism is connected to the motor 126 for rotation with the output shaft of the motor 126.

The pair of clutches 132, 134 of the clutch mechanism are not always in meshing engagement with each other. That is, the clutches 132 and 134 are brought into engagement with each other when an abrasive machining operation is not performed, and when the abrasive machining unit U is positioned at a predetermined position. When the pin portions 14 of the crankshaft 10 are lapped by the abrasive tape T, as indicated in FIG. 6, the pair of tape cartridges 70 are pivoted or oscillated in the vertical plane as described above. If the motor 126 was permanently connected to the rotary shaft 130, it would be necessary to provide suitable means for preventing disconnection of an electric cable connected to the motor 126, and the weight of the tape cartridge 70 would be undesirably increased. In the present invention, therefore, the motor 126 is disconnected from the rotary shaft 130 of the tape cartridge 70 during an abrasive machining operation on the workpiece 10.

Figure 8:
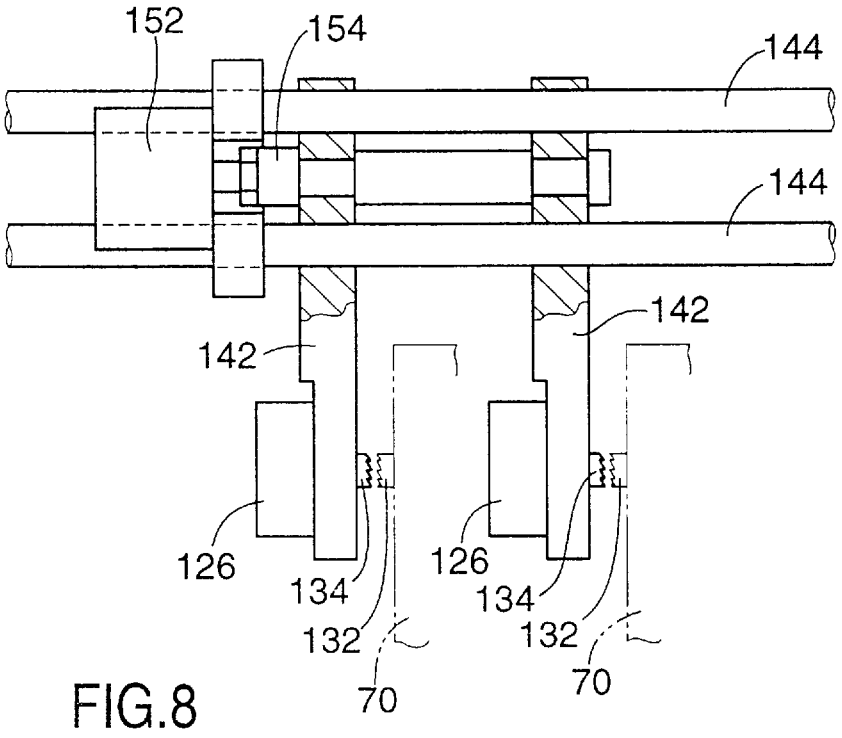
FIG. 8 is a front elevational view partly in cross section showing a motor for taking up an abrasive tape, and the associated components of the tape cartridge of FIG. 6.

Referring next to FIG. 8, there is indicated a relationship between the two motors 126 and the two tape cartridges 70 when the motors 126 are disconnected from the tape cartridges 70, in the case where the abrasive machining system has two abrasive machining units U.

As shown in FIG. 8, each motor 126 is mounted on a movable member in the form of a slider 142. To the frame 20, there are fixed two parallel guide bars 144 extending in the direction parallel to the rotary shaft 130 of each tape cartridge 70. The sliders 142 are supported by the guide bars 144, slidably in the direction of extension of the guide bars 144. The clutch 134 connected to each motor 126 is normally disengaged from the clutch 132 connected to the rotary shaft 130, as shown in FIG. 8. In this condition, the corresponding tape cartridge 70 can be pivoted in the vertical plane. The sliders 142 are connected to a piston rod 154 of an air cylinder 152, so that the sliders 142 are movable relative to the tape cartridges 70 upon activation of the air cylinder 152. When the motors 126 are connected to the rotary shafts 130 of the tape cartridges 70, the clamp arms 38 are positioned at the predetermined position with the pin 50 engaging the pin hole 48 in the body portion 36. In this position, the air cylinder 152 is activated to move the piston rod 154 to its advanced position to thereby move the sliders 142 and the motors 126 toward the tape cartridges 70, so that the clutch 134 is coupled to the clutch 132. Thus, the motors 126 are connected to the rotary shafts 130. In this condition, the motors 126 are turned on to rotate the take-up reel 94 to thereby feed the abrasive tape T. A manner of controlling the motors 126 will be described in detail.

In each tape cartridge 70, the unused abrasive tape T is wound as a roll on the supply reel 92, and a portion of the tape T is exposed outside the housing 90, for contact with the crankshaft 10. The used length of the tape T is taken up by the take-up reel 94. The front wall of the rectangular frame of the housing 90 is indicated at 150 in FIG. 6. In use of the tape cartridge 70, the front wall 150 faces the crankshaft 10. This front wall 150 has two apertures at the upper and lower end portions. One of these two apertures serves as a tape outlet through the tape T supplied from the supply reel 92 is led outside the housing 90, and the other aperture serves as a tape inlet through which the exposed portion of the tape T enters the housing 90 and is wound on the take-up reel 94. Each tape cartridge 70 is provided with two guide rolls 156 at the above-indicated tape inlet and outlet, respectively.

Figure 19:
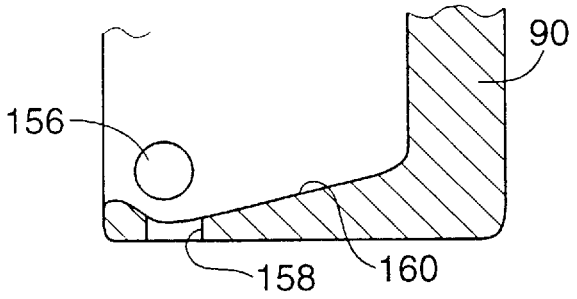
FIG. 19 is a fragmentary front elevational view in cross section showing in enlargement the tape cartridge of FIG. 6.

Each of the upper and lower walls of the rectangular frame of the housing 90 of the tape cartridge 70 has a through-hole 158 for discharging the machining liquid from inside the housing 90. During an abrasive machining operation on the crankshaft 10, the machining liquid tends to adhere on the abrasive tape T and is introduced into the tape cartridge 70 when the tape T is fed from the supply reel 92 toward the take-up reel 94. As shown in FIG. 19, the through-hole 158 is formed adjacent to each of the two guide rolls 156, which are likely to collect the liquid carried by the abrasive tape T. The upper and lower walls of the housing 90 through which the through-holes 158 are formed have an inclined surface 160 for facilitating a flow of the liquid in the cartridge 70 into the through-hole 158 by gravity.

To the front wall 150 of the housing 90, there is removably attached the shoe 95 by suitable fastening means such as screws. The shoe 95 functions to hold a part of the exposed portion of the abrasive tape T (which extends outside the housing 90, between the two guide rolls 156) in pressing contact with an appropriate portion of the circumferential surface of the journal or pin portion 12, 14 of the crankshaft 10, which portion (referred to as "lapping portion") is to be lapped by the tape T. In the present embodiment, the shoe 95 which contacts the inner surface of the exposed portion of the tape T has a generally V-shaped groove formed at its end face, so that the tape T contacts the lapping portion of the crankshaft 10 at two points which are spaced apart from each other in the circumferential direction of the journal or pin portion 12, 14.

Figure 20A:
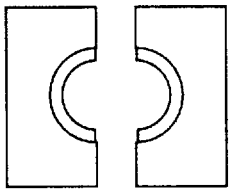
FIGS. 20(*a*) and 20(*b*) are front elevational views of modified shoes used in the abrasive machining unit.
Figure 20B:
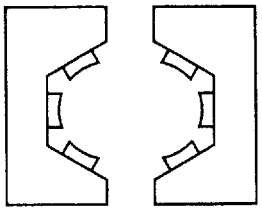

While the shoe 95 as the pressing member has the generally V-shaped end face for pressing contact of the tape T with the outer circumferential surface of the workpiece 10 at the two circumferentially-spaced-apart positions, the pressing member may have various other shapes or configurations. For instance, the pressing member may be adapted to press the tape T for contact with the workpiece at a single point, or over a single relatively ample area. An example of shoes in the latter case is illustrated in FIG. 20(*a*). These shoes have respective contact members each having a part-cylindrical inner surface (having a C shape in cross section, for example), for pressing the tape T onto the workpiece, over the entire area of the part-cylindrical inner surface. For instance, each shoe has a semi-cylindrical contact member.

The shoe may be adapted to press the tape T onto the workpiece, at three or more areas that are spaced apart from each other in the circumferential direction of the lapping portion of the workpiece. An example of this modification is illustrated in FIG. 20(*b*). Each of the shoes of FIG. 20(*b*) has three contact members having respective part-cylindrical surfaces. The three contact members are spaced apart from each other so that the tape T is pressed by these contact members onto respective circumferentially-spaced-apart surface areas of the workpiece.

In the present embodiment, the shoe 95 consists of a contact portion for contact with the tape T, and a base portion attached to the housing 90. These contact and base portions are made of respective different materials. For instance, the contact portion is made of a ceramic material having a comparatively high wear resistance, while the base portion is made of a steel material.

However, the shoe 95 may be made of any other materials. For example, the contact portion contacting the tape T may be made of urethane or other elastic material which is elastically yieldable during an abrasive machining operation.

When the tape cartridge 70 is accommodated in the cartridge accommodating space 74, it is required to prevent the tape cartridge 70 from being removed out of the space 74. It is also required to prevent rattling movements of the tape cartridge 70 in the space 74 during an abrasive machining operation. To these ends, the cartridge 70 and the clamp arms 38 are provided with a lock mechanism for locking the cartridge 70 within the space 74 in the tape holder 24. This lock mechanism will be described by reference to FIGS. 6, 9, 10(*a*) and 10(*b*).

As shown in FIG. 6, the rectangular frame of the housing 90 has the rear wall 170 opposite to the front wall 150 indicated above. This rear wall 170 has a cutout 172 adjacent to the lock chamber 104. The cutout 172 permits a lock plate 176 (which will be described) to enter the lock chamber 104 when the tape cartridge 70 is inserted into the accommodating space 74. The cutout 172 is U-shaped as indicated in FIG. 10(*a*) and is open in the direction parallel to the axes of rotation of the supply and take-up reels 92, 94.

Figure 9:
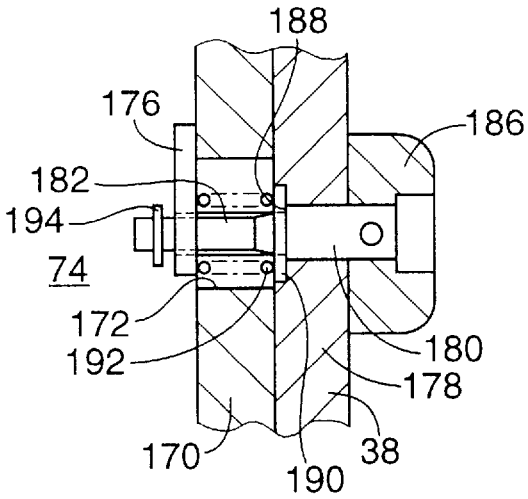
FIG. 9 is a side elevational view in cross section showing in enlargement a locking mechanism of the tape cartridge of FIG. 6.

As shown in FIG. 9, the lock plate 176 is fixed to an end portion of a rotary shaft 180 supported by the clamp arm 38. The rotary arm 180 extends through a bottom wall 178 of the clamp arm 38 which defines the bottom of the cartridge accommodating space 74. Thus, the rotary arm 180 is rotatably supported by the bottom wall 178. The rotary shaft 180 has an externally threaded portion 182 within the cartridge accommodating space 74. The lock plate 176 is threaded at its fixed end to the externally threaded portion 182. An operating portion 186 is fixed to the end portion of the rotary shaft 180, which end portion is located on the outer side of the clamp arm 38.

The rotary shaft 180 has a stepped surface 188 at an axially intermediate portion thereof, and a retainer 190 is fitted on the stepped surface 188 such that the retainer 190 is prevented from moving toward the operating portion 186. Between the retainer 190 and the lock plate 176, there is disposed an elastic or biasing member in the form of a coil spring 192. Under a biasing force of the spring 192, the lock plate 176 is prevented from easily rotating relative to the rotary shaft 180. An E-ring 194 is provided on the end portion of the rotary shaft 180, as means for preventing the lock plate 176 from being removed from the rotary shaft 180.

Figure 10A:
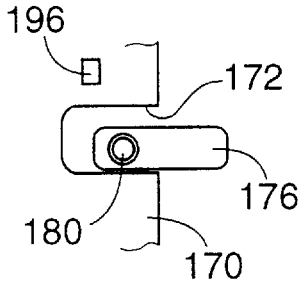
FIGS. 10(*a*) and 10(*b*) are front views showing the locking mechanism placed in unlocked and locked states, respectively.
Figure 10B:
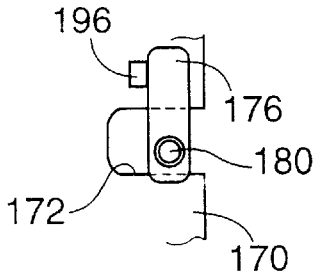

When the tape cartridge 70 is not installed in the space 74, the lock plate 176 is placed in an unlock position of FIG. 10(*a*) in which the lock plate 176 extends in the horizontal direction, that is, in the direction parallel to the direction of extension of the cartridge 70 when the cartridge is inserted into the space 74. In this unlock position, therefore, the lock plate 176 does not interfere with the rear plate 170 of the cartridge 70 when the cartridge 70 is inserted into the space 74.

After the cartridge 70 has been inserted in position in the space 74 in the tape holder 24, the operating portion 186 is operated by the user or operator of the present abrasive machining system, so that the lock plate 176 is rotated with the rotary shaft 180, to a lock position of FIG. 10(*b*). This rotation of the lock plate 176 is possible since there exists a gap between the lock plate 176 and the inner surface of the rear wall 170 of the cartridge. In the lock position of FIG. 10(*b*), the lock plate 176 extends in the vertical direction perpendicular to the direction of extension of the cutout 172. The rear plate 170 is provided with a stop 196 for preventing the lock plate 176 from further rotating from the vertical position. Thus, the lock plate 176 placed in the lock position or vertical position prevents the rear wall 170 from moving past the lock plate 176, thereby preventing the cartridge 70 from being removed from the space 74.

In the lock position of the lock plate 176 in which the lock plate 176 is perpendicular to the direction of extension of the cutout 172, however, there exists a gap between the lock plate 176 and the inner surface of the rear wall 170, as described above. This gap permits the cartridge to rattle during an abrasive machining operation on the workpiece. To eliminate this gap, the operator rotates the operating portion 186 even after the lock plate 176 has been rotated to its lock position determined by the stop 196. Since the lock plate 176 is not fixedly secured to the rotary shaft 180 but is threaded to the externally threaded portion 182, the further rotation of the rotary shaft 180 by the operating portion 186 causes the lock plate 176 to move toward the operating portion while the lock plate 176 is kept in the lock position by the stop 196. As a result, the rear wall 170 and the clamp arm 38 are tightly forced against each other by and between the lock plate 176 and the operating portion 186, whereby the cartridge 70 is prevented from rattling within the space 74 during the operation of the present abrasive machining system.

The present system is provided with a device for detecting the length of the abrasive tape T which has been fed by an operation of the motor 126, and a device for detecting the used length of the tape T.

The tape feed detecting device is indicated generally at 200 in FIGS. 6 and 11. The tape feed detecting device 200 includes (a) a gear 202 which is rotated when the abrasive tape T is fed by an operation of the motor 126, and (b) a feed length sensor 204 for electrically detecting an amount of rotation of the gear 202, which corresponds to the length of the tape T which has been fed by the operation of the motor 126. In the present embodiment, the gear 202 is disposed outside the cartridge 70 and coaxially fixed to the guide roll 156 provided adjacent to the upper wall of the rectangular frame of the housing 90 of the cartridge 70. On the other hand, the feed length sensor 204 is attached to the clamp arm 38 so that the feed length sensor 204 is located adjacent to the gear 202 on the cartridge 70 when the cartridge 70 is inserted in the space 74 of the tape holder 24. The feed length sensor 204 is a proximity switch adapted to electromagnetically detect the passage of the teeth of the gear 202, which teeth are formed at a predetermined pitch on the outer circumferential surface of the gear 202. This proximity switch 204 generates signal pulses corresponding to the detected teeth of the gear 202.

The used length detecting device is indicated generally at 210 in FIGS. 6 and 11. The used length detecting device 210 includes (a) plunger 212 which is displaced according to a change in the outside diameter of the roll of the used length of the tape T wound on the take-up reel 94, and (b) a used length sensor 214 for electrically detecting an amount of displacement of the plunger 212, which corresponds to the used length of the tape T.

As shown in FIG. 11, the plunger 212 extends through the rear wall 170 of the cartridge housing 90 and the bottom wall 178 of the clamp arm 38. One of opposite ends of the plunger 212 is located adjacent to the outside diameter of the roll of the used tape T on the take-up reel 94, while the other end is located adjacent to the used length sensor 214. The plunger 212 is supported by the clamp arm 38 such that the plunger 212 is axially displaceable, and is biased toward its innermost position. This innermost position is determined so that the inner end of the plunger 212 comes into contact with the outer circumferential surface of the roll of the tape T on the take-up reel 94 when the outside diameter of this roll reaches a predetermined value. Thereafter, the plunger 212 is moved toward the outside of the clamp arm 38 as the outside diameter of the roll of the tape T increases. The used length sensor 214 is a proximity switch adapted to electromagnetically detect the outer end of the plunger 212 when the outside diameter of the roll of the used tape T exceeds a predetermined threshold value. The proximity switch 214 generates a signal upon detection of the outer end of the plunger 212.

Figure 12:
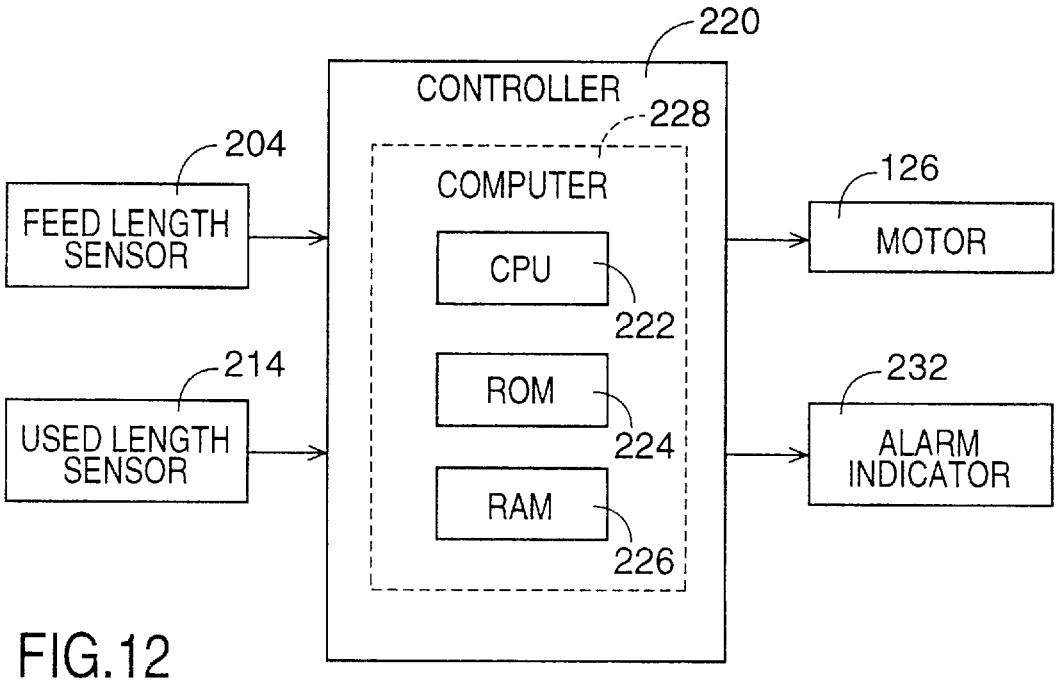
FIG. 12 is a block diagram illustrating an electric control arrangement of the abrasive machining apparatus.

The feeding of the abrasive tape T by the motor 126 is controlled by a controller 220 according to the output signals of the feed length sensor 204 and the used length sensor 214. As shown in FIG. 12, the controller 220 is principally constituted by a computer 228 incorporating a central processing unit (CPU) 222, a read-only memory (ROM) 224 and a random-access memory (RAM) 226. The controller 220 receives the output signals of the feed length sensor 204 and the used length sensor 214, and applies a control signal to the motor 126. The controller 220 also controls an alarm indicator 232, which is activated when the used length of the tape T has exceeded the predetermined threshold value, so that the operator of the present abrasive machining system is informed that the tape T has been almost consumed and should be replaced after a short period of use.

Figure 13:
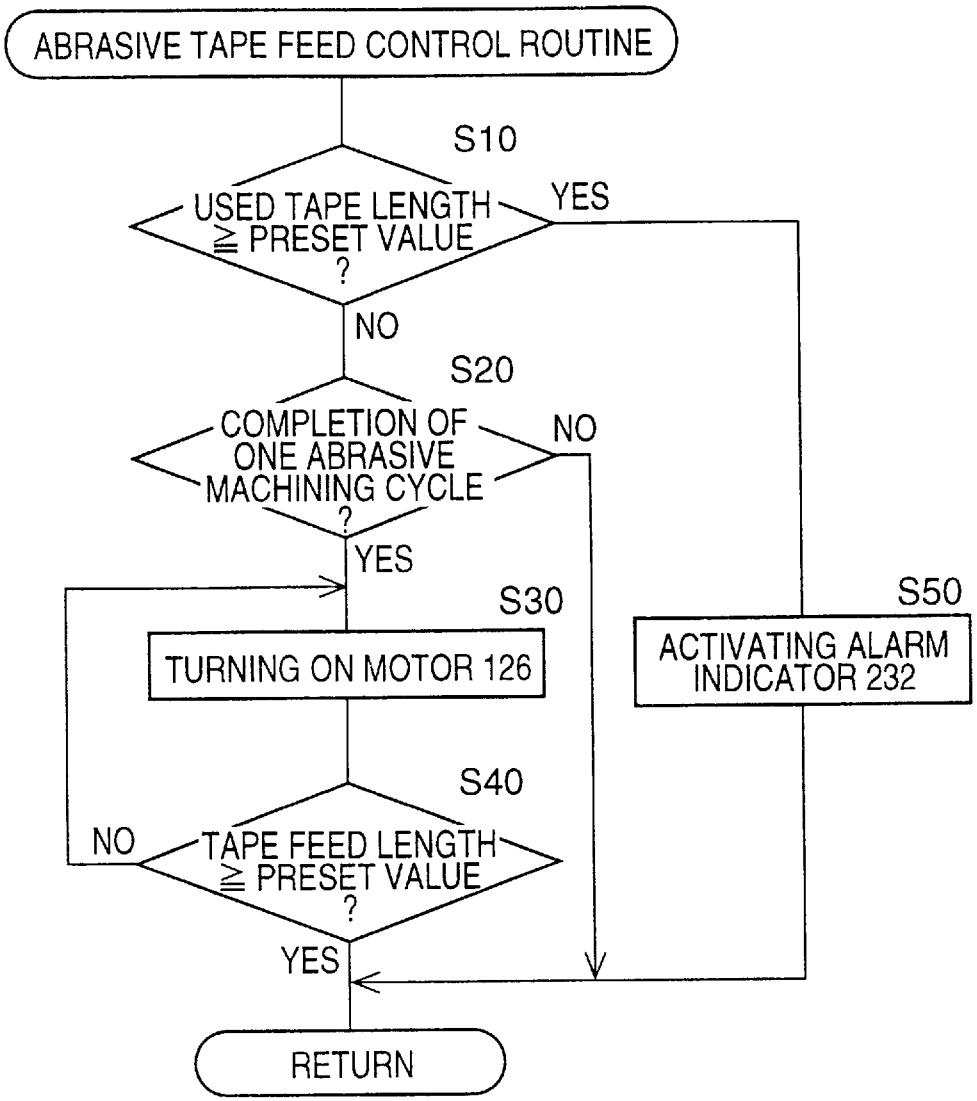
FIG. 13 is a flow chart illustrating a routine executed according to a program stored in ROM of a controller of FIG. 12, for controlling feeding of an abrasive tape.

The ROM 224 stores a routine for a program for executing a routine for controlling the feeding of the abrasive tape T, as illustrated in the flow chart of FIG. 13. The CPU 222 executes this routine to intermittently feed the abrasive tape T, while utilizing the function of the RAM 226.

The tape feed control routine of FIG. 13 is repeatedly executed. This routine is initiated with step S10 to determine whether the used length of the tape T wound on the take-up reel 94 and detected by the used length sensor 214 is equal to or larger than a predetermined threshold. If a negative decision (NO) is obtained in step S10, the control flow goes to step S20 to determine whether an abrasive machining cycle has been completed. This determination is effected based on a flag in the RAM 226. If a negative decision (NO) is obtained in step S20, one cycle of execution of the present routine is terminated.

If the abrasive machining cycle has been completed without an affirmative decision (YES) obtained in step S10 during repeated execution of the routine, that is, if the negative decision (NO) is obtained in step S10 and an affirmative decision (YES) is obtained in step S20, the control flow goes to step S30 to turn on the motor 126 which has been connected to the rotary shaft 130 of the take-up reel 94. Then, step S40 is implemented to determine whether the motor 126 should be turned off, that is, whether the length of feed of the tape T (i.e., amount of rotation of the output shaft of the motor 126) detected by the feed length sensor 204 is equal to or larger than a predetermined value. This predetermined value corresponds to a distance of feeding of the tape T necessary to feed the tape so that the unused portion of the tape is in contact with the portion of the workpiece to be machined next. That is, the used portion of the tape is not used again for abrasive machining. The motor 126 is kept operated until an affirmative decision (YES) is obtained in step S40. When the affirmative decision (YES) is obtained in step S40, one cycle of execution of the routine is terminated.

If the used length of the tape T has reached the predetermined threshold, an affirmative decision (YES) is obtained in step S10, and the control flow goes to step S50 in which the alarm indicator 232 is activated to inform the operator that the tape cartridge 70 should be replaced in the near future. Thus, one cycle of execution of the routine is terminated.

When the operator determines that the tape cartridge 70 should be replaced, the abrasive machining system is turned off, and the abrasive machining unit U in question is placed in the predetermined position (for replacing the cartridge 70 or crankshaft 10). Then, the operator moves the pair of clamp arms 38 away from each other, and remove the crankshaft 10 from the work holding device 26. Subsequently, the operator operates the operating portion 186 to place the lock plate 176 in the unlock position, and remove the tape cartridge 70 out of the space 74 of the tape holder 24. The operator then inserts the new tape cartridge 70 into the space 74, and operates the operating portion 186 to bring the lock plate 176 in the lock position.

If the supply and take-up reels 92, 94 are replaced after the tape T has been consumed, the operator removes these reels 92, 94 from the shafts 110, 130 of the tape cartridge 70, and install the new reels 92, 94 on the shafts 110, 130In this case, a portion of the abrasive tape T should be passed along the end face of the shoe 95, and the slackness of the tape T should be removed by rotating the take-up reel 94.

Where the used supply and take-up reels 92, 94 in the cartridge 70 are replaced with the new ones, the operator is required to directly touch the tape T. On the other hand, the tape cartridge 70 itself used in the abrasive machining unit U can be easily replaced by simply removing the used cartridge 70 and installing the new cartridge in the unit U, without manipulation of the tape T by operator's hands. In the present system, the tape T can be easily replaced in a reduced time by simply replacing the cartridge 70.

In the present embodiment, the shoe 95 is not provided on the tape holder 24 of the abrasive machining unit U, but is provided on the tape cartridge 70. Therefore, when the cartridge 70 is replaced, it is not necessary to remove the used tape T from the shoe 95 or pass the new tape T along the shoe 95. Accordingly, the tape T can be replaced with increased efficiency.

The shoe 95 as the tape pressing member should also be replaced as needed. Since the tape cartridge 70 is provided with the shoe 95 and is adapted to be replaced together with the shoe 95, it is not necessary to replace the shoe 95 independently of the tape T (cartridge 70). Thus, the present embodiment assures high efficiency of replacement of not only the cartridge 70 but also the shoe 95, and leads to improved efficiency of maintenance of the system.

Where the portion of the workpiece to be machined is rotated about the axis of rotation of the workpiece, the abrasive machining unit should be supported such that the abrasive machining unit is movable in a plane perpendicular to the axis of rotation of the workpiece, so that the unit follows the rotation of the machining portion of the workpiece about the axis of the workpiece. In the prior art abrasive machining apparatus, the device for supplying the abrasive tape to the abrasive machining unit and the device for taking up the used tape are fixed to the body of the apparatus. In this arrangement, the movement of the abrasive machining unit relative to the body of the apparatus so as to follow the rotation of the machining portion of the workpiece, the required positional relationship between the abrasive machining unit and the tape supply and take-up devices is lost. Therefore, special mechanisms are required to prevent disconnection or loosening of the abrasive tape which would occur due to the movement of the abrasive machining unit. In the present abrasive machining system, however, the tape supply and take-up devices are incorporated in the abrasive machining unit U, and are moved integrally with the unit U. According to this arrangement, the abrasive tape T will not be excessively tensioned or loosened during an abrasive machining operation. Accordingly, the present system does not require any special mechanisms for preventing disconnection and loosening of the tape, and is accordingly available at a reduced cost.

Figure 21:
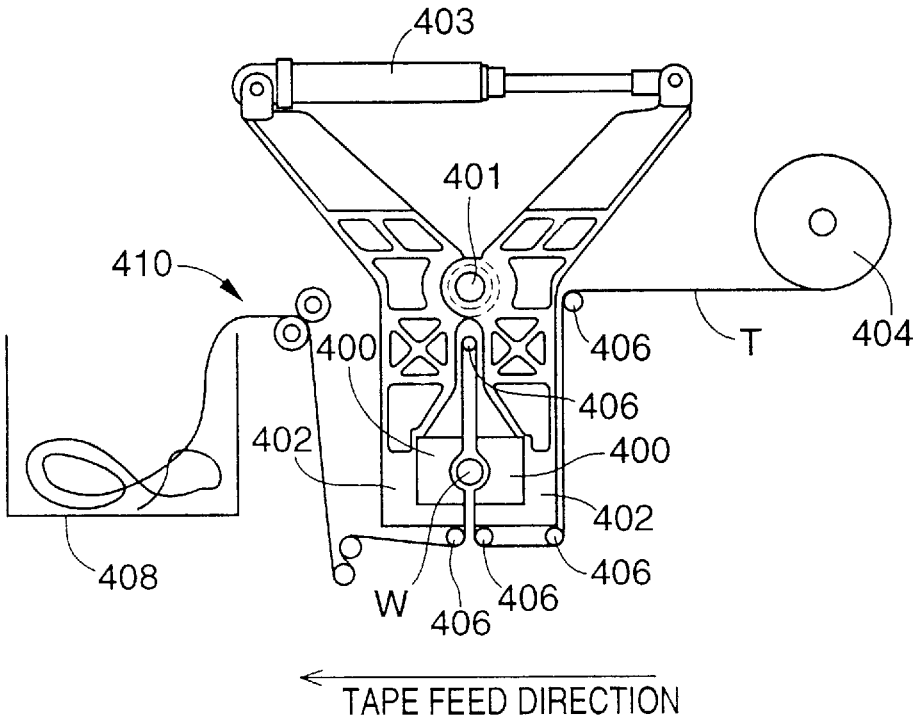
FIG.21 PRIOR ART
FIG. 21 is a front elevational view showing a known abrasive machining apparatus.

In the prior art abrasive machining apparatus shown in FIG. 21, the single abrasive tape T is contacted with the two areas of the outer circumferential surface of the workpiece W, and the tape T is tensioned when the pair of shoes 400 are moved away from each other. To avoid this tensioning of the tape T, the guide roll 406 located above the shoes 400 is elastically supported by the clamp arms 402 such that the guide roll 406 is movable toward and away from the shoes 400. In the present abrasive machining system, the two independent abrasive tapes T simultaneously contact the outer circumferential surface of the journal or pin portion 12, 14 of the crankshaft 10, and the tapes T will not be tensioned when the pair of shoes 95 are moved away from each other. Accordingly, none of the guide rolls 156 are required to be elastically supported, and the system is available at a comparatively low cost.

Figure 14:
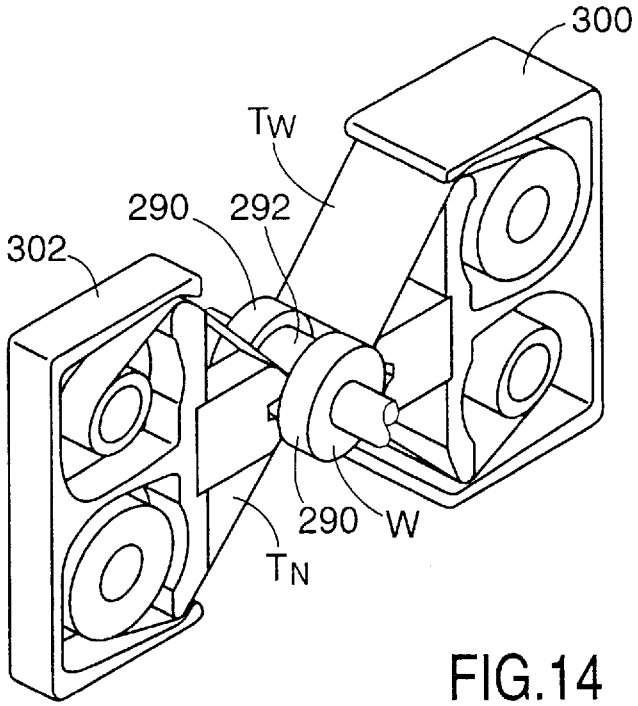
FIG. 14 is a perspective view indicating a relationship between a pair of tape cartridges and a workpiece in another embodiment of an abrasive machining apparatus of the present invention.
Figure 15:
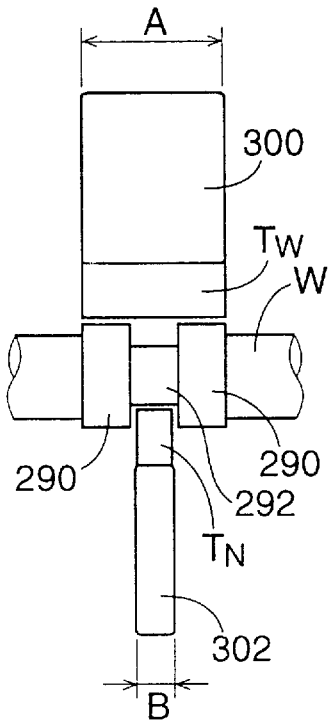
FIG. 15 is a plan view indicating the relationship between the cartridges and the workpiece in the embodiment of FIG. 14.
Figure 16:
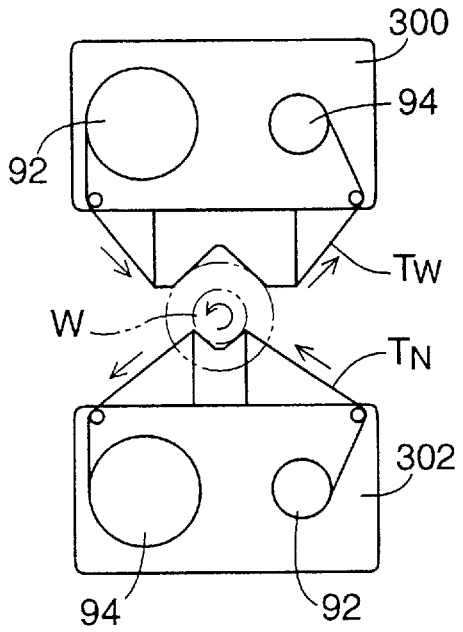
FIG. 16 is a front elevational view indicating the relationship between the cartridges and the workpiece in the embodiment of FIG. 14.

Referring next to FIGS. 14–16, there will be described an abrasive machining system constructed according to another embodiment of the present invention. The perspective view of FIG. 14 shows a set of two tape cartridges 300, 302, and a workpiece W to be machined by the present system using the tape cartridges 300, 302.

In the first embodiment, each abrasive machining unit U uses the two tape cartridges 70 of the same construction and size, and the two tapes T of the two cartridges 70 are identical with each other. If the system according to the first embodiment is used to effect abrasive machining on two large-diameter portions 290 and one small-diameter portion 292 of the workpiece W as shown in FIG. 15, a total of three abrasive machining cycles should be performed, two cycles for machining the outer circumferential surfaces of the two large-diameter portions 290, and one cycle for machining the outer circumferential surface of the small-diameter portion 292. The small-diameter portion 292 is interposed between and coaxial with the two large-diameter portions 290.

In the present second embodiment, the two cartridges 300 and 302 shown in FIG. 14 have different dimensions as measured in the axial direction of the workpiece W. The first cartridge 300 carries a wide tape $T_W$ having a width A as indicated in FIG. 15, while the second cartridge 302 carries a narrow tape $T_N$ having a width B as indicated in FIG. 15. In operation of the abrasive machining system, the three portions 290, 292 of the workpiece W are simultaneously machined using the two cartridges 300, 302. The narrow tape $T_N$ is held in contact with the small-diameter portion 292, while the wide tape $T_W$ is held in contact with the two large-diameter portions 290, as indicated in FIGS. 15 and 16. In the present system, the outer circumferential surfaces of the three portions 290, 292 can be machined in one cycle.

Although the two abrasive tapes T used by the two cartridges 300, 302 have different width dimensions in the present second embodiment, the two cartridges may use abrasive tapes which have the same width dimension but have different particles sizes or densities of the abrasives bonded thereon. Further, the two cartridges using the same abrasive tapes may be operated with different machining liquids.

Figure 17:
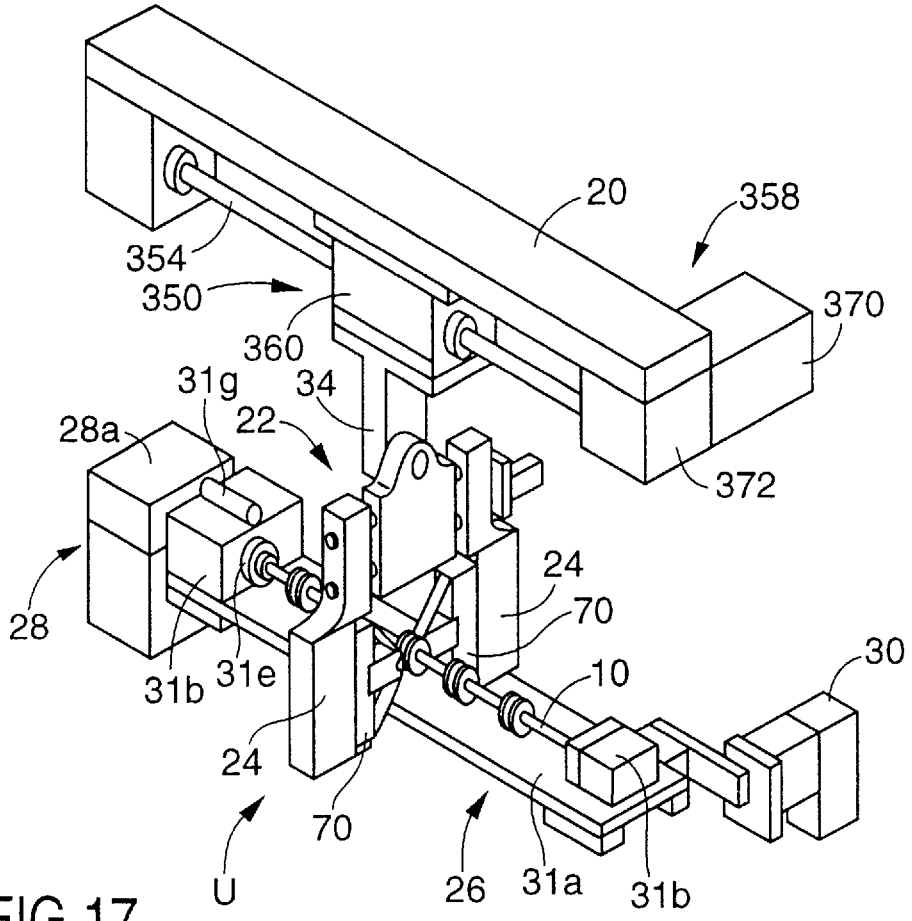
FIG. 17 is a perspective view showing an abrasive machining system including an abrasive machining apparatus constructed according to a further embodiment of this invention.

Referring to FIG. 17, there will be described an abrasive machining system constructed according to a third embodiment of this invention.

The preceding embodiments use a plurality of abrasive machining units U each of which includes two tape cartridges 70 300, 302 and which correspond to the respective portions of the workpiece W to be machined. That is, the number of the units U is the same as the number of the portions of the workpiece to be machined. In the present third embodiment, however, only one abrasive machining unit U is provided, and this unit U is moved in the axial direction of the workpiece 10 after each portion of the workpiece 10 is machined. To this end, there is provided a relative displacement mechanism 350 supported by the frame 20. The downward extension 34 is attached to a movable member of this mechanism 350.

In the present third embodiment, the relative displacement mechanism 350 is of a screw feed type including (a) a feedscrew 354 which extends in the axial direction of the workpiece 10, (b) a feedscrew rotating device 358 for rotating the feedscrew 354, and (c) a movable member in the form of a slider 360 which is threaded to the feedscrew 354 and is supported by the frame 20 such that the slider 360 is not rotated about the feedscrew 354 relative to the frame 20. The slider 360 is reciprocated in the longitudinal direction of the feedscrew 354, by bidirectional rotations of the feedscrew 354. The downward extension 34 which has been described in detail with respect to the first embodiment is attached to the underside of the slider 360.

In the present embodiment, the feedscrew rotating device 358 includes (a) an electric motor as a drive source, and (b) a drive torque transmission mechanism 372 for transmitting a drive torque of the motor 370 to the feedscrew 354.

In the present embodiment, the motor 370 is activated to rotate feedscrew 354 for feeding the abrasive machining unit U by a predetermined distance along the workpiece 10, upon completion of each abrasive machining operation on a given portion of the workpiece 10, so that the abrasive machining unit U is positioned at a portion of the workpiece 10 to be machined next. Then, an abrasive machining operation is performed on that portion of the workpiece 10.

In the illustrated embodiments, the moment and distance of feeding of the abrasive tape T are the same for all of the portions of the workpiece W to be machined. However, at least one of the moment and distance of feeding of the tape T may be different for the different portions of the workpiece.

Although the illustrated embodiments are adapted such that the two abrasive tapes of each abrasive machining unit U are used to simultaneously machine the respective two areas of a portion of the workpiece to be machined, each abrasive unit U may use only one abrasive tape T for machining one portion of the workpiece, or three or more abrasive tapes may be used to simultaneously machine respective three or more portions of the workpiece.

While the present invention have been described in detail in its presently preferred embodiments, for illustrative purpose only, it is to be understood that the invention may be embodied with various other changes, modifications and improvements, which may occur to those skilled in the art, without departing from the spirit and scope of the invention defined in the following claims;

What is claimed is:

1. An abrasive machining apparatus for performing an abrasive machining operation on a surface of a predetermined portion of a workpiece such that an abrasive tape and the workpiece are moved relative to each other while said abrasive tape is held in pressing contact with said surface of said predetermined portion of the workpiece, and feeding said abrasive tape in a longitudinal direction thereof, said apparatus comprising:

a tape holding portion;

a tape cartridge removably held by said tape holding portion and carrying said abrasive tape, said tape cartridge including (a) a housing, (b) a tape supply portion disposed in said housing and accommodating an unused length of said abrasive tape such that a portion of said unused length is exposed outside said housing, (c) a pressing member attached to said housing, for pressing said portion of said unused length outside said housing onto said surface of said predetermined portion of said workpiece, and (d) a take-up portion disposed in said housing and accommodating a used length of said abrasive tape which has been used for abrasive machining of said surface of said predetermined portion of the workpiece in pressing contact therewith; and a tape feeding device including a drive source which is activated to feed said abrasive tape in said longitudinal direction by a predetermined distance before or after said abrasive machining operation, and a mechanism for selectively connecting said drive source to and from said tape cartridge such that said drive source is disconnected from said tape cartridge during said abrasive machining operation, and is connected to said tape cartridge before or after said abrasive machining operation to feed said abrasive tape by said predetermined distance.

2. An abrasive machining apparatus according to claim 1, wherein said tape supply portion includes a supply reel accommodating said unused length of said abrasive tape, and said take-up portion includes a take-up reel for winding said used length of said abrasive tape.

3. An abrasive machining apparatus according to claim 1, further comprising a tape feeding device including a drive source which is activated to feed said abrasive tape in said longitudinal direction by a predetermined distance before, during or after said abrasive machining operation.

4. An abrasive machining apparatus according to claim 1, further comprising:

a work holding device for holding said workpiece rotatably about an axis thereof;

a work rotating device for rotating said workpiece about said axis during said abrasive machining operation while said workpiece is rotatably held by said work holding device; and a tape feeding device for feeding said abrasive tape in said longitudinal direction by a predetermined distance each time said abrasive machining operation is completed, so that a portion of said unused length of the abrasive tape is exposed outside said housing of said tape cartridge and brought into contact with said surface of said predetermined portion of the workpiece, and wherein said work rotating device is operated to rotate said workpiece while said tape feeding device is held off to hold said abrasive tape stationary, whereby said abrasive tape and said workpiece are moved relative to each other to thereby perform said abrasive machining operation.

5. An abrasive machining apparatus according to claim 1, wherein said tape holding portion comprises two tape holders each of which removably holds said tape cartridge, said two tape holders being arranged so that unused portions of the abrasive tapes exposed outside the housings of the two tape cartridges are opposed to each other and positioned on opposite sides of said predetermined portion of the workpiece.

6. An abrasive machining apparatus according to claim 1, wherein said tape holding portion comprises a plurality of tape holders each of which removably holds said tape cartridge, said plurality of tape holders being arranged in a plane perpendicular to an axis of said workpiece such that unused portions of the abrasive tapes exposed outside the housings of said plurality of tape cartridges are located in said plane and arranged about said axis of the workpiece.

7. An abrasive machining apparatus according to claim 1, further comprising a controller for controlling a feeding of said abrasive tape.

8. An abrasive machining apparatus for performing an abrasive machining operation on a surface of a predetermined portion of a workpiece such that a plurality of abrasive tapes and said workpiece are moved relative to each other while said abrasive tapes are held in pressing contact with said surface of said predetermined portion of the workpiece at a plurality of predetermining machining positions which are located in a plane intersecting an axis of said workpiece, and for feeding said abrasive tapes in a longitudinal direction thereof, said apparatus comprising:

a plurality of tape holders for holding portions of said plurality of abrasive tapes at said plurality of predetermined machining positions, respectively, independently of each other wherein, said plurality of abrasive tapes include a plurality of tapes having different widths, said plurality of tape holders including a plurality of holders for holding said plurality of tapes having different widths, respectively.

9. An abrasive machining apparatus according to claim 8, wherein each of the at least three tape holders comprises a body portion, and a tape cartridge removably held by said tape holder and including (a) a housing, (b) a tape supply portion disposed in said housing and accommodating an unused length of said abrasive tape such that a portion of said unused length is exposed outside said housing, and (c) a take-up portion disposed in said housing and accommodating a used length of said abrasive tape which has been used for abrasive machining of said surface of said predetermined portion of the workpiece in pressing contact therewith.

10. An abrasive machining apparatus according to claim 8, further comprising:

a work holding device for holding said workpiece rotatably about an axis thereof;

a work rotating device for rotating said workpiece about said axis during said abrasive machining operation while said workpiece is rotatably held by said work holding device; and a tape feeding device for feeding said plurality of abrasive tapes in said longitudinal direction by a predetermined distance each time said abrasive machining operation is completed, so that a portion of an unused length of each of said abrasive tapes is brought into contact with said surface of said predetermined portion of the workpiece, and wherein said work rotating device is operated to rotate said workpiece while said tape feeding device is held off to hold said abrasive tapes stationary, whereby said abrasive tapes and said workpiece are moved relative to each other to thereby perform said abrasive machining operation.

11. An abrasive machining apparatus for performing an abrasive machining operation on each of at least one continuous surface of a workpiece such that said workpiece rotates about an axis thereof while a plurality of abrasive tapes are held stationary in pressing contact with said each continuous surface of said workpiece at a plurality of predetermined machining positions, respectively, said plurality of predetermined machining positions being located in each of at least one plane perpendicular to said axis of said workpiece and passing through said each continuous surface, respectively, and for feeding said plurality of abrasive tapes in a longitudinal direction thereof, said apparatus comprising:

a plurality of tape holders for holding said plurality of abrasive tapes at said plurality of predetermined machining positions, respectively, independently of each other, each of said plurality of tape holders being movable rectilinearly.

12. An abrasive machining apparatus according to claim 11, wherein said plurality of tape holders include two tape holders which are arranged so that unused portions of the abrasive tapes are opposed to each other and positioned on opposite sides of said each continuous surface of said workpiece.

13. An abrasive machining apparatus for performing an abrasive machining operation on a surface of a predetermined portion of a workpiece such that said workpiece is rotated about an axis of said workpiece while two abrasive tapes are held stationary in pressing contact with said surface of the predetermined portion of the workpiece at different positions, and for feeding said abrasive tape in a longitudinal direction thereof, said apparatus comprising:

a frame;

a clamp unit connected to said frame and including a pair of clamps which are located in a plane perpendicular to said axis of said workpiece which are movable rectilinearly toward and away from each other;

a pair of tape holders supported by said pair of clamps, respectively, said pair of tape holders holding said two abrasive tapes, respectively, independently of each other;

a tape feeding device for feeding said two abrasive tapes in said longitudinal direction while said two abrasive tapes are held by said tape holders;

a work holding device for holding said workpiece rotatably about an axis thereof; and a work rotating device for rotating said workpiece about said axis during said abrasive machining operation while said workpiece is rotatably held by said work holding device.

14. An abrasive machining apparatus according to claim 13, wherein said clamp unit is connected to said frame such that said clamp unit is movable relative to said frame in a plane intersecting said axis of said workpiece rotatably held by said work holding device, and wherein said predetermined portion of said workpiece is radially offset from said axis and rotates about said axis when said workpiece is rotated by said workpiece rotating device, said clamp unit being moved relative to said frame in said plane so that said pair of tape holders supported by said pair of clamps of said clamp unit follow the rotation of said predetermined portion of said workpiece about said axis of the workpiece.

15. An abrasive machining apparatus for performing an abrasive machining operation on a surface of a predetermined portion of a workpiece such that an abrasive tape and the workpiece are moved relative to each other while said abrasive tape is held in pressing contact with said surface of said predetermined portion of the workpiece, and for feeding said abrasive tape in a longitudinal direction thereof, said apparatus comprising:

a tape holding portion;

a tape cartridge removably held by said tape holding portion and carrying said abrasive tape, said tape cartridge including (a) a housing, (b) a tape supply portion disposed in said housing and accommodating an unused length of said abrasive tape such that a portion of said unused length is exposed outside said housing, said tape supply portion includes a supply reel accommodating said unused length of said abrasive tape, (c) a pressing member attached to said housing, for pressing said portion of said unused length outside said housing onto said surface of said predetermined portion of said workpiece, (d) a take-up portion disposed in said housing and accommodating a used length of said abrasive tape which has been used for abrasive machining of said surface of said predetermined portion of the workpiece in pressing contact therewith, said take-up portion includes a take-up reel for winding said used length of said abrasive tape and (e) a mechanism for providing to said supply reel a resistance to rotation thereof when said unused length of said abrasive tape is pulled out of said supply reel by said take-up reel.

16. An abrasive machine apparatus according to claim 15, wherein said mechanism includes an elastic member interposed between said housing of said tape cartridge and said supply reel.

17. An abrasive machining apparatus according to claim 16, wherein said elastic member consists of an annular steel washer which is disposed coaxially with said supply reel and which is corrugated in a circumferential direction thereof so as to provide alternate raised and recessed portions extending in a radial direction thereof.

18. An abrasive machining apparatus according to claim 16, wherein said tape cartridge further comprises a mechanism which is operated to change an amount of deformation of said elastic member for thereby adjusting said resistance to rotation of said supply reel.

19. An abrasive machining apparatus for performing an abrasive machining operation on a surface of a predetermined portion of a workpiece such that an abrasive tape and the workpiece are moved relative to each other while said abrasive tape is held in pressing contact with said surface of said predetermined portion of the workpiece, and feeding said abrasive tape in a longitudinal direction thereof, said apparatus comprising:

a tape holding portion;

a tape cartridge removably held by said tape holding portion and carrying said abrasive tape, said tape cartridge including (a) a housing, (b) a tape supply portion disposed in said housing and accommodating an unused length of said abrasive tape such that a portion of said unused length is exposed outside said housing, said tape supply portion includes a supply reel accommodating said unused length of said abrasive tape, (c) a pressing member attached to said housing, for pressing said portion of said unused length outside said housing onto said surface of said predetermined portion of said workpiece, and (d) a take-up portion disposed in said housing and accommodating a used length of said abrasive tape which has been used for abrasive machining of said surface of said predetermined portion of the workpiece in pressing contact therewith, said take-up portion includes a take-up reel for winding said used length of said abrasive tape, said take-up reel having a one-way clutch and being mounted on said housing of said tape cartridge such that said one-way clutch permits said take-up reel to rotate in a first direction for winding said used length of said abrasive tape and inhibits said take-up reel from rotating in a second direction opposite said first direction.

20. An abrasive machining apparatus for performing an abrasive machining operation on a surface of a predetermined portion of a workpiece such that an abrasive tape and the workpiece are moved relative to each other while said abrasive tape is held in pressing contact with said surface of said predetermined portion of the workpiece, and for feeding said abrasive tape in a longitudinal direction thereof, said apparatus comprising:

a tape holding portion;

a tape cartridge removably held by said tape holding portion and carrying said abrasive tape, said tape cartridge including (a) a housing, (b) a tape supply portion disposed in said housing and accommodating an unused length of said abrasive tape such that a portion of said unused length is exposed outside said housing, said tape supply portion includes a supply reel accommodating said unused length of said abrasive tape, (c) a pressing member attached to said housing, for pressing said portion of said unused length outside said housing onto said surface of said predetermined portion of said workpiece, and (d) a take-up portion disposed in said housing and accommodating a used length of said abrasive tape which has been used for abrasive machining of said surface of said predetermined portion of the workpiece in pressing contact therewith, said take-up portion includes a take-up reel for winding said used length of said abrasive tape;

a tape feeding device for feeding said abrasive tape in said longitudinal direction by a predetermined distance, said tape feeding device including a motor for rotating said take-up reel;

a feed length sensor provided on said tape holding portion, for detecting a length of said abrasive tape which has been fed by said tape feeding device; and a controller for controlling said motor of said tape feeding device, according to an output signal of said feed length sensor.

21. An abrasive machining apparatus for performing an abrasive machining operation on a surface of a predetermined portion of a workpiece such that an abrasive tape and the workpiece are moved relative to each other while said abrasive tape is held in pressing contact with said surface of said predetermined portion of the workpiece, and for feeding said abrasive tape in a longitudinal direction thereof, said apparatus comprising:

a tape holding portion;

a tape cartridge removably held by said tape holding portion and carrying said abrasive tape, said tape cartridge including (a) a housing, (b) a tape supply portion disposed in said housing and accommodating an unused length of said abrasive tape such that a portion of said unused length is exposed outside said housing, said tape supply portion includes a supply reel accommodating said unused length of said abrasive tape, (c) a pressing member attached to said housing, for pressing said portion of said unused length outside said housing onto said surface of said predetermined portion of said workpiece, and (d) a take-up portion disposed in said housing and accommodating a used length of said abrasive tape which has been used for abrasive machining of said surface of said predetermined portion of the workpiece in pressing contact therewith, said take-up portion includes a take-up reel for winding said used length of said abrasive tape;

a used length sensor for detecting said used length of said abrasive tape which is currently wound on said take-up reel;

an alarm indicator for informing an operator of the apparatus of a necessity of replacing said tape cartridge; and a controller for activating said alarm indicator according to an output signal of said used length sensor.

22. An abrasive machining apparatus for performing an abrasive machining operation on a surface of a predetermined portion of a workpiece such that an abrasive tape and the workpiece are moved relative to each other while the abrasive tape is held in pressing contact with the surface of the predetermined portion of the workpiece and for feeding the abrasive tape in a longitudinal direction thereof, the abrasive machining apparatus comprising:

a frame;

a tape holding device connected to the frame and operative to move pivotally and vertically relative to the frame; and a tape cartridge removably held by the tape holding device for carrying the abrasive tape, the tape cartridge including (a) a housing, (b) a tape supply portion disposed in the housing and accommodating an unused length of the abrasive tape such that a portion of the unused length is exposed outside the housing, (c) a pressing member connected to the housing for pressing the portion of the unused length outside the housing onto the surface of the predetermined portion of the workpiece, and (d) a take-up portion disposed in the housing and accommodating a used length of the abrasive tape which has been used for abrasive machining of the surface of the predetermined portion of the workpiece in pressing contract therewith.

23. An abrasive machining apparatus according to claim 22, further comprising a driver connected to the tape holding device for moving the tape holding device and the tape cartridge rectilinearly between a non-contact position wherein the abrasive tape is held away from the workpiece and a contact position wherein the abrasive tape is held in pressing contact with the workpiece.

24. An abrasive machining apparatus for performing an abrasive machining operation on a surface of a predetermined portion of a workpiece such that said workpiece is rotated about an axis of said workpiece while two abrasive tapes are held stationary in pressing contact with said surface of the predetermined portion of the workpiece at different positions, and for feeding said abrasive tape in a longitudinal direction thereof, said apparatus comprising:

a frame;

a clamp unit connected to said frame and including a pair of clamps which are located in a plane perpendicular to said axis of said workpiece which are movable toward and away from each other;

a pair of tape holders supported by said pair of clamps, respectively, said pair of tape holders holding said two abrasive tapes, respectively, independently of each other;

a tape feeding device for feeding said two abrasive tapes in said longitudinal direction while said two abrasive tapes are held by said tape holders;

a work holding device for holding said workpiece rotatably about an axis thereof; and a work rotating device for rotating said workpiece about said axis during said abrasive machining operation while said workpiece is rotatably held by said work holding device, wherein said clamp unit is connected to said frame such that said clamp unit is movable relative to said frame in a plane intersecting said axis of said workpiece rotatably held by said work holding device, and wherein said predetermined portion of said workpiece is radially offset from said axis and rotates about said axis when said workpiece is rotated by said workpiece rotating device, said clamp unit being moved relative to said frame in said plane so that said pair of tape holders supported by said pair of clamps of said clamp unit follow the rotation of said predetermined portion of said workpiece about said axis of the workpiece.

25. An abrasive machining apparatus for performing an abrasive machining operation on a surface of a predetermined portion of a workpiece such that a plurality of abrasive tapes and said workpiece are moved relative to each other while said abrasive tapes are held in pressing contact with said surface of said predetermined portion of the workpiece at a plurality of predetermined machining positions which are located in a plane intersecting an axis of said workpiece, and for feeding said abrasive tapes in a longitudinal direction thereof, said apparatus comprising:

a plurality of tape holders for holding portions of said plurality of abrasive tapes at said plurality of predetermined machining positions, respectively, each of said plurality of abrasive tapes including a substrate and abrasive particles bonded to a surface of said substrate, said plurality of abrasive tapes including a plurality of tapes different from each other in at least one of size and density of said abrasive particles on the surface of said substrate.

* * * * *